US005759299A

United States Patent [19]

Yokoyama et al.

[11] Patent Number: 5,759,299

[45] Date of Patent: Jun. 2, 1998

[54] RAIL HAVING EXCELLENT RESISTANCE TO ROLLING FATIGUE DAMAGE AND RAIL HAVING EXCELLENT TOUGHNESS AND WEAR RESISTANCE AND METHOD OF MANUFACTURING THE SAME

[75] Inventors: Hiroyasu Yokoyama; Sadahiro Yamamoto; Kazutaka Kobayashi, all of Tokyo, Japan

[73] Assignee: NKK Corporation, Tokyo, Japan

[21] Appl. No.: 682,800

[22] Filed: Jul. 29, 1996

Related U.S. Application Data

[63] Continuation-in-part of Ser. No. 436,524, May 8, 1995, abandoned, and Ser. No. 677,250, Jul. 9, 1996, abandoned, which is a continuation-in-part of Ser. No. 491,636, Jun. 19, 1995, abandoned.

[30] Foreign Application Priority Data

May 10, 1994 [JP] Japan ..... 6-096539
Sep. 27, 1994 [JP] Japan ..... 6-256054

[51] Int. Cl.[6] ..... C21D 8/00

[52] U.S. Cl. ..... 148/333; 148/334; 148/335; 148/584

[58] Field of Search ..... 148/333, 334, 148/335, 584

[56] References Cited

U.S. PATENT DOCUMENTS 4,767,475 8/1988 Fukuda et al. .
5,209,792 5/1993 Besch et al. .
5,382,307 1/1995 Kageyama et al. .

FOREIGN PATENT DOCUMENTS 55-2768 1/1980 Japan .
63-128123 5/1988 Japan .
63-23244 5/1988 Japan .
2-282448 11/1990 Japan .
5-271871 10/1993 Japan .

*Primary Examiner*—Deborah Yee
*Attorney, Agent, or Firm*—Frishauf, Holtz, Goodman, Langer & Chick, P.C.

[57] ABSTRACT

A high-abrasion bainite rail excellent in resistance to rolling fatigue and failure, consisting essentially of 0.15 to 0.55 wt. % of C, 0.05 to 1.0 wt. % of Si, 0.1 to 2.5 wt. % of Mn, 0.03 wt. % or less of P, 0.03 wt. % or less of S, 0.1 to 3.0 wt. % of Cr, 0.005 to 2.05 wt. % of Mo, and the balance being iron and inevitable impurities. The head portion of the rail has a uniform bainite structure. The Vickers hardness at any position of the head top portion and the head corner portion is 240 to 400 Hv. A rail of high toughness and high wear resistance, consisting essentially of 0.2 to 0.5 wt. % of C, 0.1 to 2.0 wt. % of Si, 1.0 to 3.0 wt. % of Mn, 0.035 wt. % or less of P, 0.035 wt. % or less of S, 0.3 to 4.0 wt. % of Cr, and the balance being iron and inevitable impurities. The rail has a bainite structure, a hardness of greater than 400 Hv at each of a head top portion and a head corner portion thereof, both the head top portion and the head corner portion having a substantially uniform hardness at all sections thereof. The rail having a tensile strength of 1200 MPa or more, and a 2 mm, U-notch Charpy absorbed energy of 30 J or more at +20° C.

30 Claims, 5 Drawing Sheets

RAIL HAVING EXCELLENT RESISTANCE TO ROLLING FATIGUE DAMAGE AND RAIL HAVING EXCELLENT TOUGHNESS AND WEAR RESISTANCE AND METHOD OF MANUFACTURING THE SAME

This application is a continuation-in-part application of (i) application Ser. No. 08/436,524 filed May 8, 1995 (now abandoned) and (ii) application Ser. No. 08/677,250 filed Jul. 9, 1996 (now abandoned) which is a Continuation In Part of application Ser. No. 08/491,636 (now abandoned) filed Jun. 19, 1995 (now abandoned). The entire contents of application Ser. Nos. 08/436,524 and 08/677,250 are hereby incorporated by reference.

BACKGROUND OF THE INVENTION

1. Field of the Invention

The present invention relates to a rail excellent in damage resistance against a rolling fatigue damage which occurs in the head top and corner portions and determines the service life of a rail in a railroad.

The present invention also relates to a high-toughness, high wear-resistance rail, and more particularly to a rail with great wear-resistant and damage-resistant, enough to serve in high-rate transportation railroads and heavy-duty mine railroads and which has strength, toughness and wear-resistance great enough to serve in cold districts. The invention also relates to a method of manufacturing the rail.

2. Description of the Related Art

Railroad transportation has a higher transportation efficiency than other transportation systems. High-speed railroad transportation has been demanded, and railroad schedules have been overcrowded year by year. The loads on rails have become severer year by year. For this reason, the rolling fatigue and damage have increased on the rail head top surface of a straight rail portion and the head corner portions of a curved rail portion.

The characteristics currently required for rails has been higher, and demand has arisen for a rail excellent in damage resistance against the rolling fatigue.

A heat-treated rail is known as such a rail, as disclosed in Jpn. Pat. Appln. KOKAI Publication No. 55-2768. The head portion of the rail is heated again to a high temperature and cooled from a predetermined temperature range, and the head portion is cooled at a rate of 10.5° C./sec to 15° C./sec in the temperature range of 700° C. to 650° C., thereby obtaining the heat-treated rail. As this heat-treated rail has a head portion with a high hardness, it exhibits excellent characteristics suitable for use in railroads having high-axle load.

Jpn. Pat. Appln. KOKAI Publication No. 2-282448 discloses a rail in which the C content is slightly lower than that in a conventional rail to set a difference in hardness between the head top and corner portions of the rail, thereby improving the resistance to rolling fatigue damage.

In a railroad having a high-axle load, countermeasures such as coating of a lubricant to suppress rail abrasion and use of a high-strength rail have been taken. For this reason, fatigue is accumulated in rails to increase the rolling fatigue damage on the head top surface of a straight rail portion and the head corner portions of a curved rail portion. A countermeasure against this drawback has not been proposed yet.

All the causes of damage on the head top surface are not necessarily clarified yet. According to one of the causes, the rail surface is rapidly heated and cooled by wheel slippage during traction of a freight car having a high-axle load and acceleration or deceleration of a train, and a martensite layer called a white layer is formed on the surface of the rail. Since this white layer is very hard and brittle, cracks occur and develop at the boundary with the matrix to cause a rolling fatigue damage.

The cause of the rolling fatigue damage at the gage corner portion is estimated as follows. Although the contact condition is very severe and the shearing stress acting on the interior of the rail is large, the position where the shearing stress acts does not change by abrasion, so that the stress is concentrated on a specific area, thereby causing a rolling fatigue damage.

The hardness of the white layer is generally determined by the C content. As the C content is higher, the white layer has a higher hardness and becomes brittler. The conventional rails including the one disclosed in Jpn. Pat. Appln. KOKOKU Publication No. 55-2388 have C contents as high as 0.65% to 0.85%. For this reason, when a white layer is formed, such a rail has a higher hardness, resulting in inconvenience. In addition, a conventional rail has a pearlite structure whose microstructure is fine, and a soft ferrite layer and a hard cementite layer constitute a lamellar structure. For this reason, the conventional rail is hardly abraded. Once a white layer is formed on the rail, it cannot be removed by abrasion upon contact between the rail and the wheels of a train during train traveling. The white layer becomes the starting point of a damage.

To solve the above problem, the present inventors have studied on a rail in which a white layer has a low hardness or a rail in which a white layer can be removed by abrasion upon contact between the rail and wheels during train traveling even if the white layer is formed. Since the hardness of the white layer is uniquely determined by the C content, it is very effective to reduce the C content so as to reduce the hardness of the white layer. However, when the C content is simply reduced, the resultant rail has a low strength and suffers a large plastic flow on its surface. This leads to another damage such as a creaking crack.

To the contrary, for example, Jpn. Pat. Appln. KOKAI Publication No. 2-282448 discloses a rail having a low C content. Only the head corner portions of this rail are heat-treated to obtain a high hardness. That is, since the corner portions have a high hardness, a damage such as a creaking crack caused by a low strength can be prevented, and at the same time the white layer on the head top portion can be removed by abrasion.

In actual train traveling in a railroad, however, the contact between the rails and wheels is not uniform, and the wheels may be brought into contact with portions near the high-hardness head corner portions. In this case, the wheel is not brought into contact with the head top portion, so removal of the white layer by an increased abrasion amount, which is the primary purpose, cannot be achieved. It is therefore difficult to remove the white layer, and the rolling fatigue damage cannot be effectively prevented.

Hitherto, rails for use in railroads have been developed to be stronger, in terms of wear-resistance, rolling-fatigue resistance and the like, which are considered important properties required of the rails. Rails for use in railroads need to be even stronger since the railroad transportation has recently become more speedy and more heavy-duty, applying a high axle-load on the rails. Particularly in cold districts such as Russia and Canada, rails having excellent toughness are demanded. The ordinary rails at present have but insufficient toughness; their 2 mm, U-notch Charpy absorbed energy is as small as 10 J or less at 20° C. It is difficult to increase their Charpy absorbed energy by 5 J.

One of methods of improving the toughness is heat treatment. Rails may be heat-treated to acquire an increased toughness in one of the following two alternative methods.

In the first method generally known as "off-line heat treatment." In this method, rails made by rolling are cooled. Thereafter, they are heated to $Ac_3$ point or a higher temperature and subjected to accelerated cooling. (See Jpn. Pat. Appln. KOKAI Publication No. 63-128123.)

In the second method known as "on-line heat treatment." In this method, rails made by rolling and remaining at $Ar_3$ point or a higher temperature are subjected to accelerated cooling. (See Jpn. Pat. Appln. KOKOKU Publication No. 63-23244.)

The off-line method may increase the strength and toughness of the rail, since the microstructure of the steel is transformed at low temperatures by accelerated cooling and microstructure of the steel is made finer by repeatedly transforming the microstructure of the steel. The method, however, is undesirable in view of heat efficiency because the rails must be heated before they are subjected to accelerated cooling.

The on-line method excels in heating efficiency because the rails are subjected to accelerated cooling immediately after having been made by rolling. However, the method can hardly improve the toughness of rails greatly, though strengthening of the rails may be due to the accelerated cooling, if the rails are of the conventional steel composition.

Conventional rails are made of steel having a fine pearlite structure to have high strength and high wear-resistance. Since they have a pearlite structure, they cannot have their toughness increased greatly. It is proposed that rails be made of bainitic steel to have great toughness. However, a bainite structure is said to less resistant to wear than a fine pearlite structure, though it is superior to a fine pearlite structure in terms of toughness.

Jpn. Pat. Appln. KOKAI Publication No. 2-282448 discloses a rail which is made of steel having a C content slightly lower than the conventional steel, the top and corner portions of which differ in hardness, and which has an improved resistance to rolling-fatigue damage. Jpn. Pat. Appln. KOKAI Publication No. 5-271871 discloses a rail which is made of bainitic steel having a C content slightly lower than the conventional steel so that its top portion may be sufficiently resistant to rolling-fatigue damage. Neither rail has an improved toughness, however. Further, the bainitic steel rail disclosed in Publication No. 5-271871 is disadvantageous in that its service life will be shorten if it is used in mine railroads and is inevitably subjected to a high axle-load. This is because it is intended to increase the wear amount of the rail to improve resistance to rolling-fatigue damage of the rail.

As mentioned above, conventional rails of a pearlite structure can hardly have their toughness improved greatly, whereas conventional rails of a bainite structure are intended to increase the wear amount of the rail to improve the resistance to rolling-fatigue damage which is increased. No technique is available which can provide rails which excel in both toughness and wear-resistance.

SUMMARY OF THE INVENTION

The present invention has been made in consideration of the above situation, and has as an object to provide a high-abrasion bainite rail excellent in resistance to rolling fatigue damage.

Another object of the present invention is to provide a rail excellent in toughness, strength and wear resistance, and a method of manufacturing the same.

According to a first embodiment of the present invention, there is provided a high-abrasion bainite rail excellent in resistance to rolling fatigue damage, the rail essentially consisting of 0.15 to 0.55 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.05 wt % of Mo, and the balance of iron and unavoidable impurities, a head portion of the rail has a uniform bainite structure, and a hardness at any position of a head top portion and a head corner portion of the rail falls within the range of 240 to 400 in Vickers hardness Hv.

According to a second embodiment of the present invention, there is provided a high-abrasion bainite rail excellent in resistance to rolling fatigue damage the rail essentially consisting of 0.15 to 0.55 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.0 wt % of Mo, at least one element selected from the group consisting of 0.005 to 0.01 wt % of Nb, 0.005 to 0.05 wt % of V, and 0.001 to 0.01 wt % of Ti, and a balance of iron and inevitable impurities, a head portion of the rail has a uniform bainite structure, and a hardness at any position of a head top portion and a head corner portion of the rail falls within the range of 240 to 400 in Vickers hardness Hv.

According to a third embodiment of the present invention, there is provided a high-abrasion bainite rail excellent in resistance to rolling fatigue damage, the rail essentially consisting of 0.15 to 0.55 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.05 wt % of Mo, at least one element selected from the group consisting of 0.05 to 2.0 wt % of Cu and 0.05 to 2.0 wt % of Ni, and a balance of iron and inevitable impurities, a head portion of the rail has a uniform bainite structure, and a hardness at any position of a head top portion and a head corner portion of the rail falls within the range of 240 to 400 in Vickers hardness Hv.

According to a fourth embodiment of the present invention, there is provided a high-abrasion bainite rail excellent in resistance to rolling fatigue damage, the rail essentially consisting of 0.15 to 0.55 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.0 wt % of Mo, at least one element selected from the group consisting of 0.005 to 0.01 wt % of Nb, 0.005 to 0.05 wt % of V, and 0.001 to 0.01 wt % of Ti, at least one element selected from the group consisting of 0.05 to 2.0 wt % of Cu and 0.05 to 2.0 wt % of Ni, and a balance of iron and inevitable impurities, a head portion of the rail has a uniform bainite texture, and a hardness at any position of a head top portion and a head corner portion of the rail falls within the range of 240 to 400 in Vickers hardness Hv.

According to a fifth embodiment of the present invention, there is provided a rail of high toughness and high wear resistance, consisting essentially of 0.2 to 0.5 wt %,of C, 0.1 to 2.0 wt % of Si, 1.0 to 4.0 wt % of Mn, 0.035 wt % or less of p, 0.035.wt % or less of S, 0.3 to 4.0 wt % of Cr, and the balance of iron and inevitable impurities, the rail having a metal structure of a bainite structure (uniform bainite structure), a hardness of higher than 400 Hv at each of a head top portion and a head corner portion thereof, both the head top portion and the head corner portion having a substantially uniform hardness at all sections of the head top portion and the head corner portion, i.e., the head top portion and the head corner portion have substantially the same hardness, a tensile strength of 1200 MPa or more, and a 2 mm, U-notch Charpy absorbed energy of 30 J or more at +20° C.

According to a six embodiment of the present invention, there is provided a rail of high toughness and high wear resistance, consisting essentially of 0.2 to 0.5 wt % of C, 0.1 to 2.0 wt % of Si, 1.0 to 4.0 wt % of Mn, 0.035 wt % or less of P, 0.035 wt % or less of S, 0.3 to 4.0 wt % of Cr, and the balance of iron and inevitable impurities, the rail having a metal structure of a bainite structure (uniform bainite structure), and a hardness of higher than 400 Hv at each of a head top portion and a head corner portion thereof, both the head top portion and the head corner portion having a substantially uniform harness at all sections of the head top portion and the head corner portion, i.e., the head top portion and the head corner portion have substantially the same hardness.

According to a seventh embodiment of the invention, there is provided a method for manufacturing a rail of high toughness and high wear resistance, comprising the steps of:

(a) preparing a steel consisting essentially of 0.2 to 0.5 wt % of C, 0.1 to 2.0 wt % of Si, 1.0 to 4.0 wt % of Mn, 0.035 wt % or less of P, 0.035 wt % or less of S, 0.3 to 4.0 wt % of Cr, and the balance of iron and inevitable impurities;

(b) hot rolling the steel to have a rolling finishing temperature of 800°–1000° C., thereby forming a rail stock; and (c) cooling the rail stock at a cooling rate of 5° C./sec. or less between a bainite transformation-starting temperature or more and 400° C. or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

First to Fourth Embodiments

The present inventors have considered the conventional drawbacks described above and found that if both the head top portion and the head corner portion of a rail had a uniform hardness enough not to cause a failure by a plastic flow, the rail had a fatigue strength and hardness equal to those of a conventional rail, and the entire microstructure of the head portion was a bainite structure to increase the abrasion wear 1.3 to 3.0 times that of the conventional rail, a white layer can be removed and an excellent damage resistance to rolling fatigue damage can be obtained without a complicated heat-treatment process. The present inventors also found that the addition of an alloy element in a very small amount suppresses formation of a white layer and makes the hardness uniform from the head portion to the interior of the rail although the abrasion wear remains equal to of a rail whose entire head portion had a bainite structure, thereby greatly prolonging the service life of the rail.

The present invention is made based on the above findings. According to the first embodiment of the present invention, there is provided a high-abrasion bainite rail excellent in resistance to rolling fatigue damage, wherein the rail essentially consists of 0.15 to 0.55 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.05 wt % of Mo, and the balance of iron and inevitable impurities, a head portion of the rail has a uniform bainite structure, and a hardness at any position of a head top portion and a head corner portion of the rail falls within the range of 240 to 400 in a Vickers hardness Hv.

According to the second embodiment of the present invention, there is provided a high-abrasion bainite rail excellent in resistance to rolling fatigue damage, in addition to the composition of the first embodiment, wherein the rail further contains at least one element selected from the group consisting of 0.005 to 0.01 wt % of Nb, 0.005 to 0.05 wt % of V, and 0.001 to 0.01 wt % of Ti.

According to the third embodiment of the present invention, there is provided a high-abrasion bainite rail excellent in resistance to rolling fatigue damage failure, in addition to the composition of the first embodiment., wherein the rail contains at least one element selected from the group consisting of 0.05 to 2.0 wt % of Cu and 0.05 to 2.0 wt % of Ni.

According to the fourth embodiment of the present invention, there is provided a high-abrasion bainite rail excellent in resistance to rolling fatigue damage, in addition to the composition of the second embodiment, wherein the rail contains at least one element selected from the group consisting of 0.05 to 2.0 wt % of Cu and 0.05 to 2.0 wt % of Ni.

Figure 1:
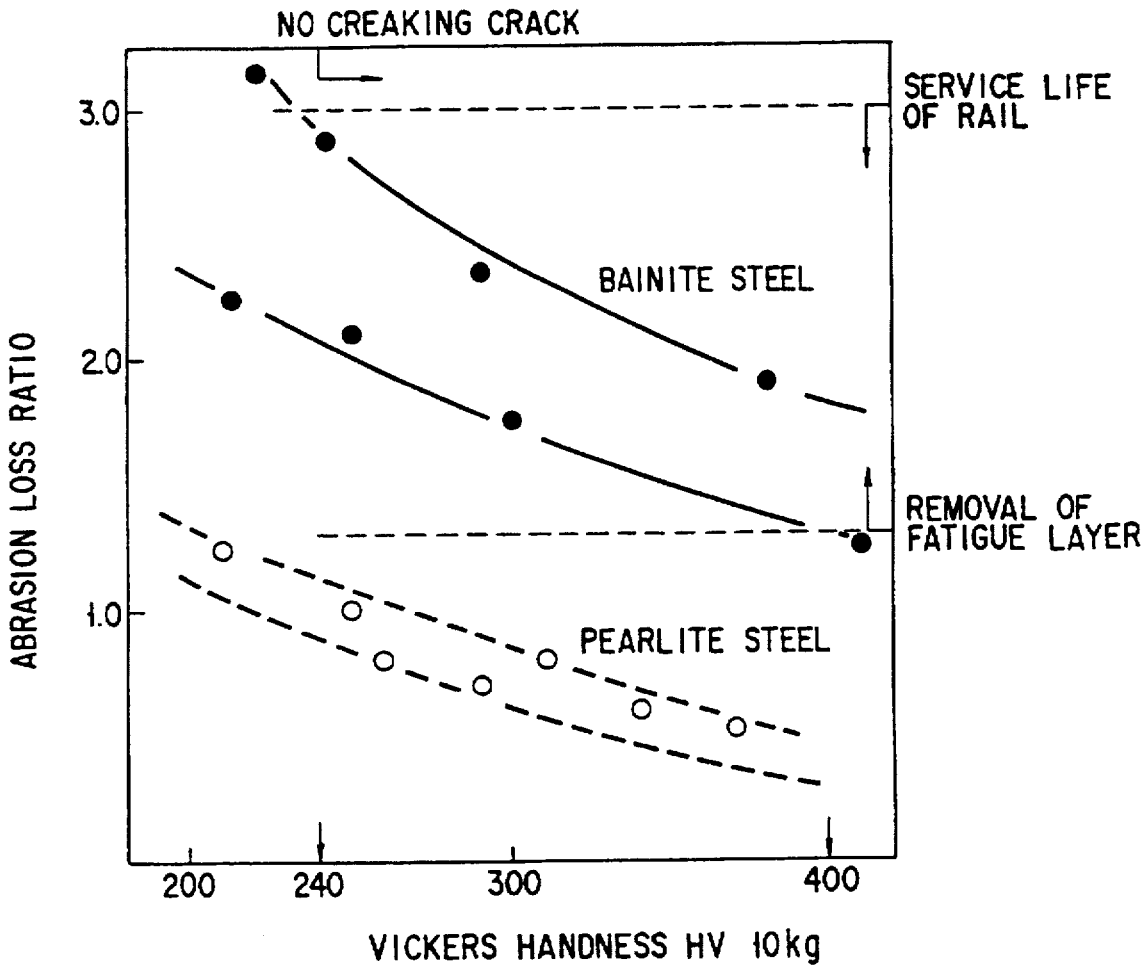
FIG. 1 is a graph showing the influences of the matrix structure and hardness on the abrasion loss ratio.

FIG. 1 shows the results obtained by checking the influences of the structure and hardness of the matrix on the abrasion loss ratio. Steel samples had compositions obtained by variously changing the contents of C, Si, Mn, Cr, Cu, Ni, Mo, V, Nb, and Ti in the component range shown in Table 1 and were 16-mm thick steel plates obtained by hot rolling. Some of the steel plates were cooled with air. Nishihara type abrasion test pieces each having an outer diameter of 30 mm and a width of 8 mm were sampled from these steel plates. An abrasion test was performed under the conditions that the contact load set in a simulation of contact between a rail and a wheel was 135 kg, the slip ratio was −10%, and no lubricant was used. The abrasion loss amount of each sample was measured upon 100,000 revolutions. In evaluation of each sample, the abrasion wear of a conventional rail was measured, and the abrasion loss ratio of the abrasion loss amount of each rail sample to that of the conventional rail was used. Note that in the column of structure in Table 1, P represents pearlite, and B represents bainite.

TABLE 1

| | Chemical Components (wt %) | | | | | | | | | | Accelerated | Micro-struc- | |
|---|---|---|---|---|---|---|---|---|---|---|---|---|---|
| No. | C | Si | Mn | Cr | Cu | Ni | Mo | V | Nb | Ti | Cooling | ture | Hv |
| A-1 | 0.68 | 0.30 | 0.65 | — | — | — | — | — | — | — | not performed | P | 210 |
| A-2 | 0.70 | 0.25 | 0.75 | — | 0.05 | 0.05 | — | — | — | — | not performed | P | 250 |
| A-3 | 0.70 | 0.29 | 0.95 | — | — | — | 0.01 | — | — | — | not performed | P | 260 |
| A-4 | 0.75 | 0.24 | 0.85 | 0.05 | — | 0.10 | — | — | 0.009 | — | performed | P | 290 |
| A-5 | 0.73 | 0.19 | 0.94 | 0.15 | 0.05 | 0.05 | — | 0.03 | — | 0.006 | performed | P | 310 |
| A-6 | 0.72 | 0.17 | 0.87 | 0.13 | — | — | — | 0.01 | 0.007 | | performed | P | 340 |
| A-7 | 0.77 | 0.18 | 0.98 | 0.22 | — | — | — | 0.02 | — | — | performed | P | 370 |
| A-8 | 0.09 | 0.10 | 0.40 | 2.95 | — | — | — | — | — | — | not performed | B | 213 |
| A-9 | 0.12 | 0.95 | 2.10 | 0.75 | — | — | 0.03 | — | — | — | not performed | B | 220 |
| A-10 | 0.15 | 0.45 | 0.45 | 2.70 | — | — | 0.04 | 0.02 | — | — | performed | B | 242 |
| A-11 | 0.0 | 0.25 | 0.50 | 1.50 | 1.05 | 0.50 | 0.02 | — | — | 0.007 | perforined | B | 250 |
| A-12 | 0.30 | 0.30 | 2.10 | 0.71 | — | — | 0.03 | — | 0.008 | — | performed | B | 290 |
| A-13 | 0.30 | 0.06 | 0.45 | 0.31 | — | — | 1.25 | — | — | — | not performed | B | 300 |
| A-14 | 0.54 | 0.97 | 0.40 | 1.40 | 0.70 | 0.40 | 0.03 | — | 0.006 | | not performed | B | 380 |
| A-15 | 0.56 | 0.31 | 2.40 | 0.80 | — | 0.30 | 0.02 | — | — | — | not performed | B | 410 |

As can be understood from FIG. 1, the abrasion loss amounts are reduced with increases in hardness of the matrices. The conventional rail has a hardness Hv of 240 or more, and this hardness does not pose any serious problem as to the creaking crack at the head corner portion of the rail. The creaking crack is caused by plastic deformation of the rail corner portion, and the plastic deformation is defined by only the strength (hardness) of the corner portion. For this reason, it is readily understood that no problem is posed if the lower hardness (Hv) limit is 240 or more. In matrices having the same hardness, the abrasion loss amount of the pearlite structure is larger than that of the bainite structure. Judging from this fact, to obtain a larger abrasion wear than that of the conventional rail to obtain an excellent damage resistance, the head portion must have a bainite structure.

Judging from various examinations of the prevent inventors, it is necessary to assure an abrasion loss ratio of 1.3 or more to remove a fatigue layer by abrasion. From the viewpoint of the planned service life of a rail, when the abrasion loss amount exceeds 3.0 times that of the conventional rail, the thickness of the rail head portion is greatly reduced before the use period reaches the planned service life, and the rail cannot be used. For this reason, the upper limit of the abrasion loss ratio is 3.0. The hardness Hv of a currently used conventional rail having a pearlite structure is about 240 to 260. It is understood from FIG. 1 that the hardness of the bainite structure whose abrasion loss ratio is 1.3 to 3.0 is 240 to 400 (Hv). Therefore, when the hardness Hv of the bainite structure as the object of the present invention is assured to fall within the range of 240 to 400, it is seen from FIG. 1 the resultant rail is satisfactory in various respects such as removal of the fatigue layer by abrasion, the service life determined by the reduction of the thickness of the rail head portion, and creaking cracks at the rail head corner portions.

Figure 2:
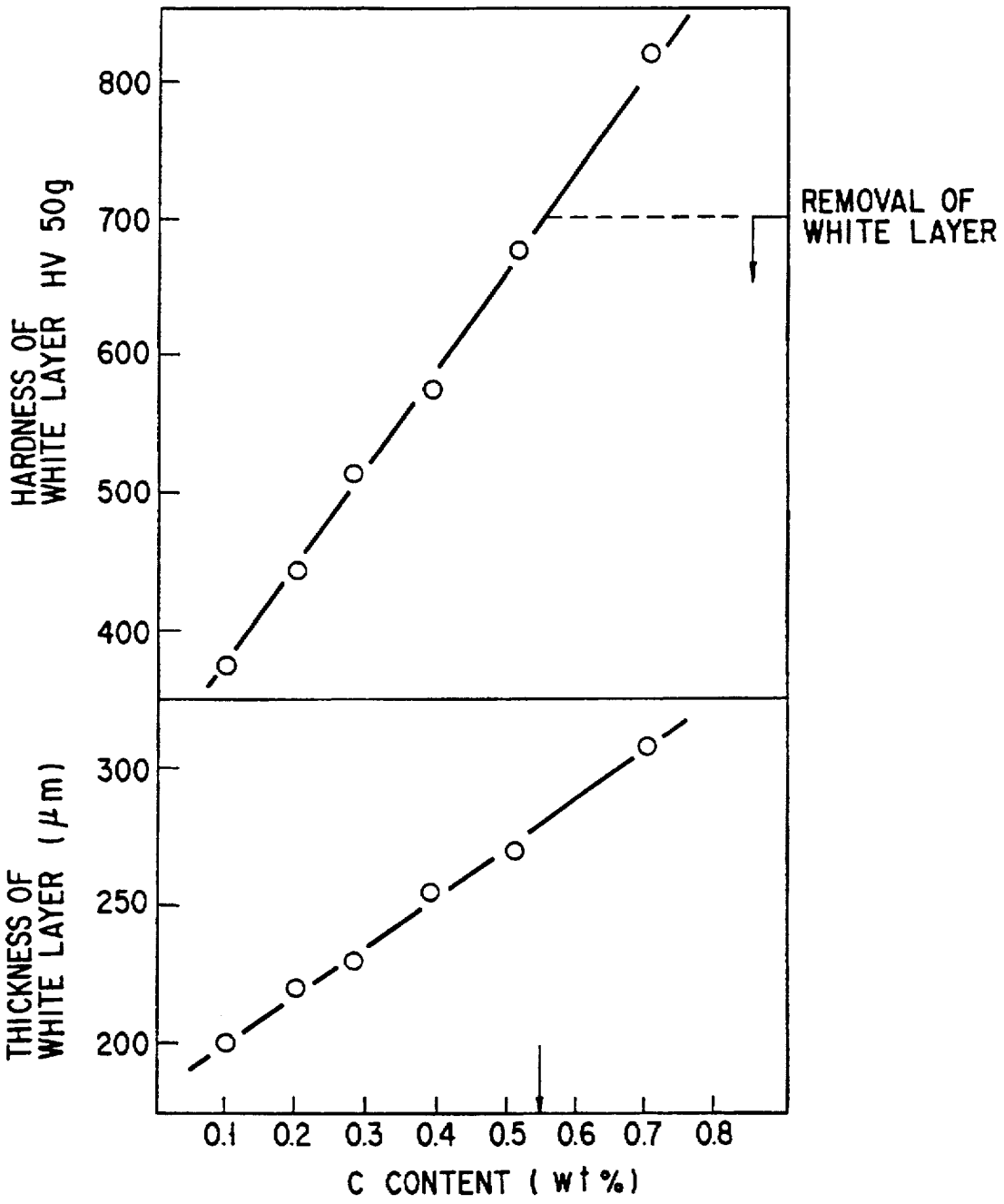
FIG. 2 is a graph showing the influences of the C content on the hardness and thickness of a white layer.

FIG. 2 shows the influences of the C content of the matrix on the hardness and thickness of a white layer formed on the surface of the head portion of a rail. Steel samples had components in which the C content was changed within the component range of Table 2, and 16-mm thick steel plates were obtained by hot rolling. Columnar pieces each having a diameter of 3 mm were sampled from these steel plates. Each columnar piece was set on the side of the Nishihara type rolling fatigue tester where a rail sample was attached. Each columnar piece was spontaneously brought into contact with a wheel test piece to simulate formation of a white layer caused by slippage in a real rail subjected to rapid heating and rapid cooling performed by forced slip. The hardness and thickness of each white layer were evaluated.

TABLE 2

| | | | | | (wt %) |
|---|---|---|---|---|---|
| No. | C | Si | Mn | Cr | Mo |
| B-1 | 0.10 | 0.30 | 0.40 | 1.24 | 0.41 |
| B-2 | 0.20 | 0.29 | 0.41 | 0.86 | 0.57 |
| B-3 | 0.28 | 0.25 | 0.39 | 1.95 | 0.03 |
| B-4 | 0.39 | 0.10 | 1.85 | 0.35 | 1.22 |
| B-5 | 0.51 | 0.50 | 0.45 | 1.58 | 0.28 |
| B-6 | 0.70 | 0.30 | 0.65 | 0.55 | 0.74 |

As can be understood from FIG. 2, the thickness of the white layer is reduced with a decrease in C content. The reason for this is estimated that the critical cooling rate in formation of a white layer, is shifted to the higher cooling rate with a decrease in C content, so a white layer is not formed in the interior where the cooling rate is low. The hardness of the white layer greatly depends on the C content, and is reduced with a decrease in C content. If a large difference in hardness is present between the white layer and the matrix, the difference becomes resistance to removal of the white layer by abrasion. It is therefore estimated that the hardness of the white layer must fall within the range of 1.75 times the hardness of the matrix. Since the upper limit of the matrix hardness is set to 400 (Hv) from the viewpoint of the abrasion loss ratio, as shown in FIG. 1, the hardness of the white layer must fall within the range of 700 (Hv) or less. Therefore, the upper limit of the C content is 0.55%.

Figure 3:
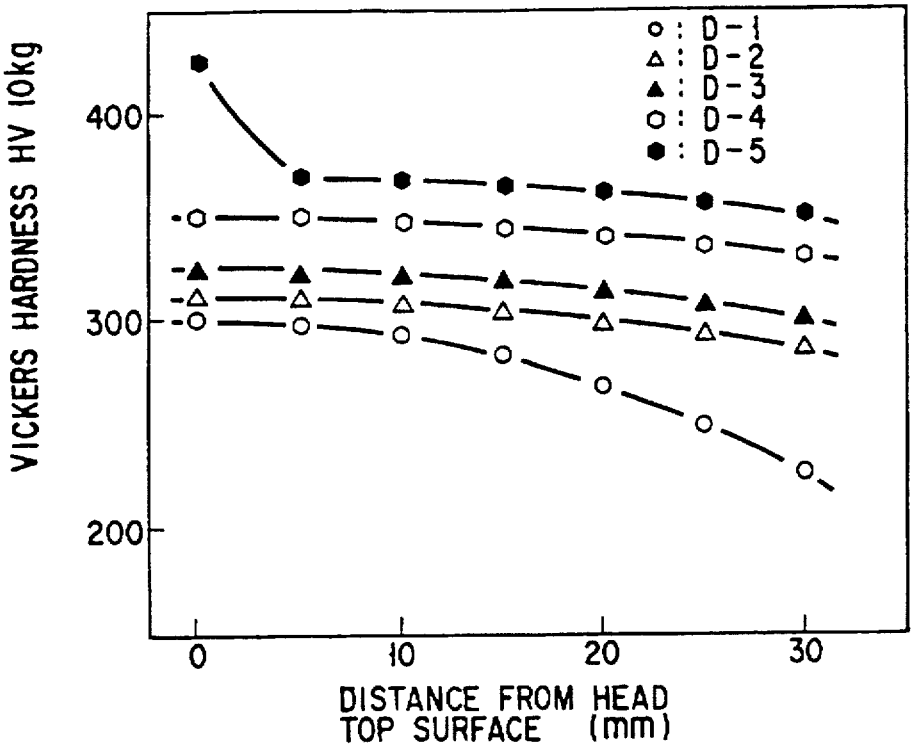
FIG. 3 is a graph showing the influences of the microalloy on the thickness of a white layer.

FIG. 3 shows the influences of a microalloy on the thickness of a white layer formed on the surface of a head top portion of a rail. Steel samples had compositions obtained by changing V, Nb, and Ti on the basis of 0.4 wt % of C in the component range of Table 3, and 16-mm thick steel plates were obtained by hot rolling. Columnar pieces each having a diameter of 3 mm were sampled from these steel plates as shown in FIG. 2. Each columnar piece was set on the side where a rail sample was attached in the Nishihara type rolling fatigue tester. Each columnar piece was spontaneously brought into contact with a wheel test piece to simulate formation of a white layer caused by slippage in a real rail subjected to rapid heating and rapid cooling performed by forced slip. The thickness of each white layer was evaluated.

TABLE 3

| No | C | Si | Mn | Cr | Mo | V | Nb | (wt %) Ti |
|---|---|---|---|---|---|---|---|---|
| C-1 | 0.40 | 0.30 | 0.45 | 2.10 | 0.05 | 0.005 | — | — |
| C-2 | 0.41 | 0.28 | 0.39 | 2.30 | 0.03 | 0.017 | — | — |
| C-3 | 0.39 | 0.15 | 0.40 | 1.97 | 0.11 | 0.028 | — | — |
| C-4 | 0.42 | 0.62 | 0.41 | 2.00 | 0.07 | 0.041 | — | — |
| C-5 | 0.41 | 0.31 | 0.43 | 2.13 | 0.04 | 0.049 | — | — |
| C-6 | 0.39 | 0.30 | 0.39 | 2.25 | 0.10 | 0.102 | — | — |
| C-7 | 0.40 | 0.28 | 0.40 | 1.99 | 0.08 | — | 0.006 | — |
| C-8 | 0.38 | 0.19 | 0.45 | 2.08 | 0.06 | — | 0.009 | — |
| C-9 | 0.42 | 0.41 | 0.38 | 2.20 | 0.02 | — | 0.016 | — |
| C-10 | 0.40 | 0.50 | 0.41 | 2.15 | 0.04 | — | — | 0.004 |
| C-11 | 0.39 | 0.30 | 1.90 | 0.91 | 0.54 | — | — | 0.009 |
| C-12 | 0.40 | 0.31 | 2.30 | 0.71 | 1.15 | — | — | 0.018 |
| C-13 | 0.41 | 0.29 | 2.40 | 0.72 | 1.07 | 0.039 | 0.005 | — |
| C-14 | 0.41 | 0.16 | 2.41 | 0.80 | 1.11 | 0.041 | 0.010 | — |
| C-15 | 0.42 | 0.46 | 2.37 | 0.75 | 1.21 | 0.038 | 0.019 | — |
| C-16 | 0.39 | 0.40 | 1.99 | 0.95 | 1.09 | 0.040 | — | 0.007 |
| C-17 | 0.40 | 0.30 | 2.15 | 0.84 | 1.02 | 0.041 | — | 0.015 |

As is apparent from FIG. 3, when V, Nb, and Ti are added, the thicknesses of white layers are reduced. V, Nb, and Ti form carbides, and these carbides are not decomposed in rapid heating. As a result, the C content in the form of a solid solution decreases to shift the critical cooling rate in formation of a white layer toward the higher cooling rate, and no white layer is formed in the interior where the cooling rate is low. By adding the above elements, the thickness of each white layer is reduced. As shown in FIG. 3, this effect is most enhanced in the case of V. Nb and T follow V because they have high carbide production performance. However, this effect is saturated at 0.05% or more for V and 0.01% or more for Nb or Ti. When Nb and Ti are added using a V-added system, as indicated by a solid mark in FIG. 3, it is readily understood that the hardness and thickness of white layer are more greatly reduced than a case in which V is added singly. Therefore, Nb and Ti are preferably added together with V.

Figure 4:
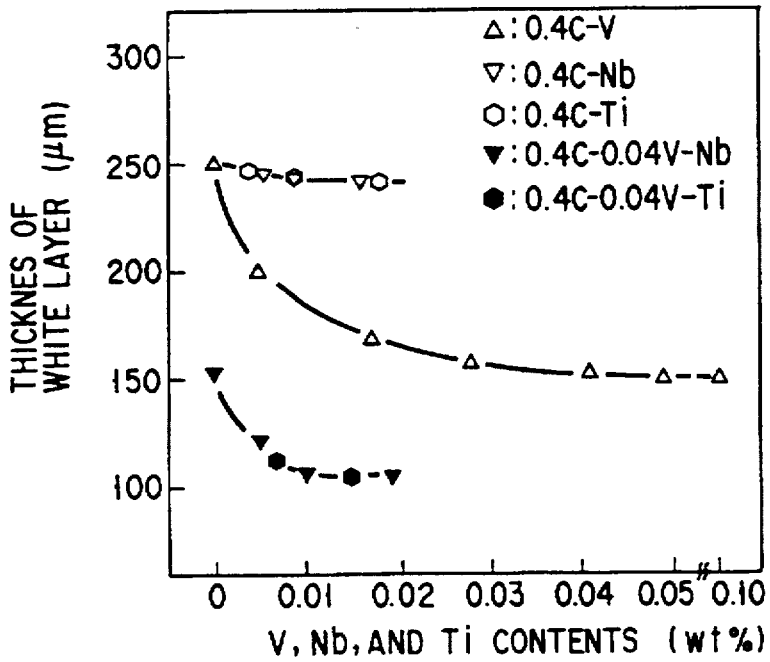
FIG. 4 is a graph showing the influences of the components on the hardness distribution from the rail head top surface to the interior of a rail.

FIG. 4 shows the influences of the matrix components on the hardness distribution from the surface of the rail head portion to a position 30 mm deep from the surface. Steel samples had compositions obtained by changing Cu, Ni, V, Nb, and Ti in the component range of Table 4 and were hot-rolled for simulation in the form of a rail head portion. The Vickers hardnesses were measured from the surface of the center of the head portion to a position 30 mm deep from the surface.

As can be understood from FIG. 4, a decrease in hardness of the interior is reduced by adding V, Nb, and Ti serving as precipitation hardening elements. This decrease in hardness is also reduced by adding a combination of Cu, Ni and Mo for increasing the hardenability of bainite. However, since the decrease in hardness of the interior of the rail is saturated even if V, Nb, and Ti are added in a large amount, the upper limit of the addition amount is 0.05% for V, 0.01% for Nb, and 0.01% for Ti. On the other hand, the addition of Cu, Ni, and Mo in a large amount is not preferable because a martensite layer is formed on the surface of a rail.

The reason why the chemical components, the microstructure, and the hardness are defined will be described below.

Chemical Component

C: 0.15% to 0.55%

C is an element which greatly influences the hardness of a white layer and the hardness of a rail itself. When the C content exceeds 0.55%, the hardness of the white layer on the rail head top portion excessively increases, and the difference between the hardness of the white layer and the hardness of the matrix excessively increases to form the start point of a shearing damage. On the other hand, when the C content is less than 0.15%, the strength of the matrix excessively decreases to accelerate a plastic flow. A damage occurs centered on the plastic flow. Therefore, the C content is defined to fall within the range of 0.15% to 0.55%.

Si: 0.05% to 1.0%

Si is an element which serves as an deoxidiser and which is dissolved in the matrix to increase the strength of the matrix. When the Si content is less than 0.05%, the addition effect of Si cannot be obtained. When the Si content exceeds 1.0%, the matrix becomes brittle. In addition, hard $SiO_2$ is dispersed in the matrix and becomes the start point of shearing. Therefore, the Si content is defined to fall within the range of 0.05% to 1.0%.

Mn: 0.1% to 2.5%

Mn is an element is dissolved in the matrix to improve hardenability to strengthen a material. When the Mn content is less than 0.10%, the addition effect of Mn is not obtained. When the Mn content exceeds 2.5%, martensite tends to be produced in a segregated portion, thus forming the start point of a damage. Therefore, the Mn content is defined to fall within the range of 0.1% to 2.5%.

P: 0.03% or less

P degrades toughness and is thus defined to fall within the range of 0.03% or less.

S: 0.03% or less

S is mainly present in the form of an inclusion in steel. When the S content exceeds 0.03%, the amount of the inclusion excessively increases to make the matrix brittle. Therefore, the S content is defined to fall within the range of 0.03% or less.

TABLE 4

| No. | C | Si | Mn | Cr | Mo | Cu | Ni | V | Nb | (wt %) Ti |
|---|---|---|---|---|---|---|---|---|---|---|
| D-1 | 0.33 | 0.30 | 0.50 | 0.31 | 1.68 | — | — | — | — | — |
| D-2 | 0.31 | 0.29 | 0.46 | 2.20 | 0.32 | — | — | 0.03 | 0.008 | 0.006 |
| D-3 | 0.32 | 0.31 | 2.48 | 0.46 | 1.27 | — | — | 0.02 | 0.021 | 0.015 |
| D-4 | 0.25 | 0.35 | 0.48 | 1.75 | 0.41 | 0.35 | 0.30 | — | — | — |
| D-5 | 0.26 | 0.19 | 2.20 | 0.73 | 0.68 | 3.01 | 2.81 | — | — | — |

Cr: 0.1% to 3.00%

Cr is an element for improving the hardenability of bainite. Cr is a very significant element to obtain a high-strength rail element in which a microstructure is set in the form of a bainite structure. If the Cr content is less than 0.1%, the hardenability of bainite is poor, and the microstructure cannot be converted into a uniform bainite structure. When the Cr content exceeds 3.0%, martensite tends to be produced, which forms the start point of a damage. Therefore, the Cr content is defined to fall within the range of 0.1% to 3.0%.

Mo: 0.005% to 2.0%

Mo is an effective element for improving the hardenability of bainite by dissolving in the matrix and imparting a high strength and high abrasion. If the Mo content is less than 0.005%, the addition effect of Mo is not obtained. When the Mo content exceeds 2.0%, martensite tends to be produced, which forms the start point of a damage. Therefore, the Mo content is defined to fall within the range of 0.005% to 2.0%.

V: 0.005% to 0.05%

V is combined with C in the matrix and precipitates upon rolling. For this reason, V allows an increase in precipitation strength to the interior of the head portion to prolong the service life of a rail. In addition, V forms a precipitate with C in rapid heating of the surface of the head portion during traveling or slip of a wheel. As this precipitate is not decomposed, the content of dissolved C in the rapidly heated portion is reduced. The hardness of the white layer is decreased to very effectively suppress a shearing damage. If the V content is less than 0.005%, the addition effect of V is not properly exhibited. If the V content exceeds 0.05%, the effect is saturated. Therefore, the V content is defined to fall within the range of 0.005% to 0.05%.

Nb: 0.005% to 0.01%

Ti: 0.001% to 0.01%

Nb and Ti are combined with C in the matrix as in V and precipitates upon rolling. For this reason, Nb and Ti allow an increase in precipitation strength to the interior of the head portion to prolong the service life of a rail. In addition, Nb and Ti form a precipitate with C in rapid heating of the surface of the head portion during traveling or slip of a wheel. As this precipitate is not decomposed, the content of dissolved C in the rapidly heated portion is reduced. The hardness of the white layer is increased to very effectively suppress a shearing damage. The addition effect of Ti and Nb is enhanced in use together with V. When the Nb and Ti contents are less than 0.005% and less than 0.001%, respectively, the addition effect of Nb and Ti is not enhanced. Even if the Nb and Ti contents exceed 0.01% respectively, the effect is saturated. In addition, the precipitate is coarsened to cause another damage. Therefore, the Nb and Ti contents are defined to fall within the ranges of 0.005% to 0.01% and 0.001% to 0.01%, respectively.

At least one element selected from the group consisting of V, Nb and Ti is added.

Cu: 0.05% to 2.0%

Ni: 0.05 to 2.0%

Both Cu and Ni are elements for effectively improving the hardenability of bainite in the form of solid solutions in the matrix, thereby effectively strengthening a material. If the Cu and Ni contents are less than the lower limits of the above ranges, the addition effect cannot be obtained. If the Cu and Ni contents exceed the upper limits of the above ranges, martensite tends to be produced, which forms the start point of a shearing damage. Each of the Cu and Ni contents is defined to fall within the range of 0.05% to 2.0%. At least one of these elements is added.

Microstructure

According to the present invention, the rail head portion is constituted by a uniform bainite structure. The bainite structure has a higher dislocation density than the pearlite structure of the conventional rail to obtain a high-strength rail. For this reason, bainite steel can have a lower C content than that of pearlite steel. In the pearlite structure a hard carbide (cementite) in an oriented lamellar structure and is hardly abraded. In contrast to this, since the carbide is dispersed as fine carbide particles in the matrix of the bainite structure, the carbide can be removed upon matrix abrasion. Therefore, the bainite structure has higher abrasion rate than the pearlite structure, i.e., is readily abraded.

When a fatigue layer is accumulated near the surface of a rail or when a crack is formed and develops in the boundary between the white layer and the base material, a rolling fatigue damages occur. In either case, the accumulated fatigue layer or the produced white layer can be abraded by contact between the rails and the wheels during train traveling, thereby suppressing the damage. When the rail head portion is constituted by a uniform bainite structure having a predetermined hardness and easily susceptible to abrasion, as described above, the rail has a high resistance to rolling fatigue damage. To effectively remove the white layer by abrasion, the abrasion wear must be larger than that of a plain rail (complying with JIS). Therefore, the head structure must be a bainite structure having high abrasion rate.

When the abrasion wear is largely excessive, the thickness of the rail head portion is greatly reduced, and a necessary service life cannot be assured. In practice, if the abrasion wear is 1.3 to 3.0 times that of the conventional rail, a necessary service life can be assured, and at the same time the resistance to rolling fatigue damage can be excellent. If a rail is manufactured using steel having a composition of the present invention and has a bainite structure having a hardness falling within the following range, the rail has an abrasion wear 1.3 to 3.0 times that of the plain rail, and no problem of short life is posed by a decrease in thickness of the head portion of the rail. The bainite structure can be obtained by cooling a rail element with air or rapidly cooling it after rolling.

The abrasion wear of a rail is most preferably evaluated by an abrasion wear measured when a rail is actually laid. A value obtained in a comparative test using a Nishihara type abrasion tester upon simulation of a contact condition of an actually laid rail is also effective.

Hardness

The hardness Hv of the head top portion and the head corner portions at any position must fall within the range of 240 to 400. If the head top portion has a bainite structure, the abrasion wear is large. For this reason, the hardness of the head top portion may be equal to that of the head corner portion without posing any problem. If the hardness Hv of the head corner portions falls within the range of 240 to 400, the plastic flow is almost equivalent to that of the conventional rail. No damage occurs having the plastic flow as a starting point. When the hardness Hv of the head corner portion exceeds 400, the abrasion wear is reduced to cause inconvenience. In addition, to obtain a hardness Hv of 400 or more in the bainite structure, the contents of alloy elements must be increased, resulting in an economical disadvantage. Therefore, the upper limit of the hardness Hv is defined as 400.

The surface region of the head portion of the rail is constituted by a head top portion and head corner portions. As long as the head corner portions and the head top portion have a hardness falling within the above range, they may have substantially the same hardness or different hardnesses.

Fifth, Sixth and Seventh Embodiments

As a result of having paid attention to a bainite structure of excellent toughness, the present invention provides a rail of high toughness, high strength and high wear resistance by forming its microstructure of bainite and adjusting its composition and manufacturing conditions so as to increase its hardness.

Figure 5:
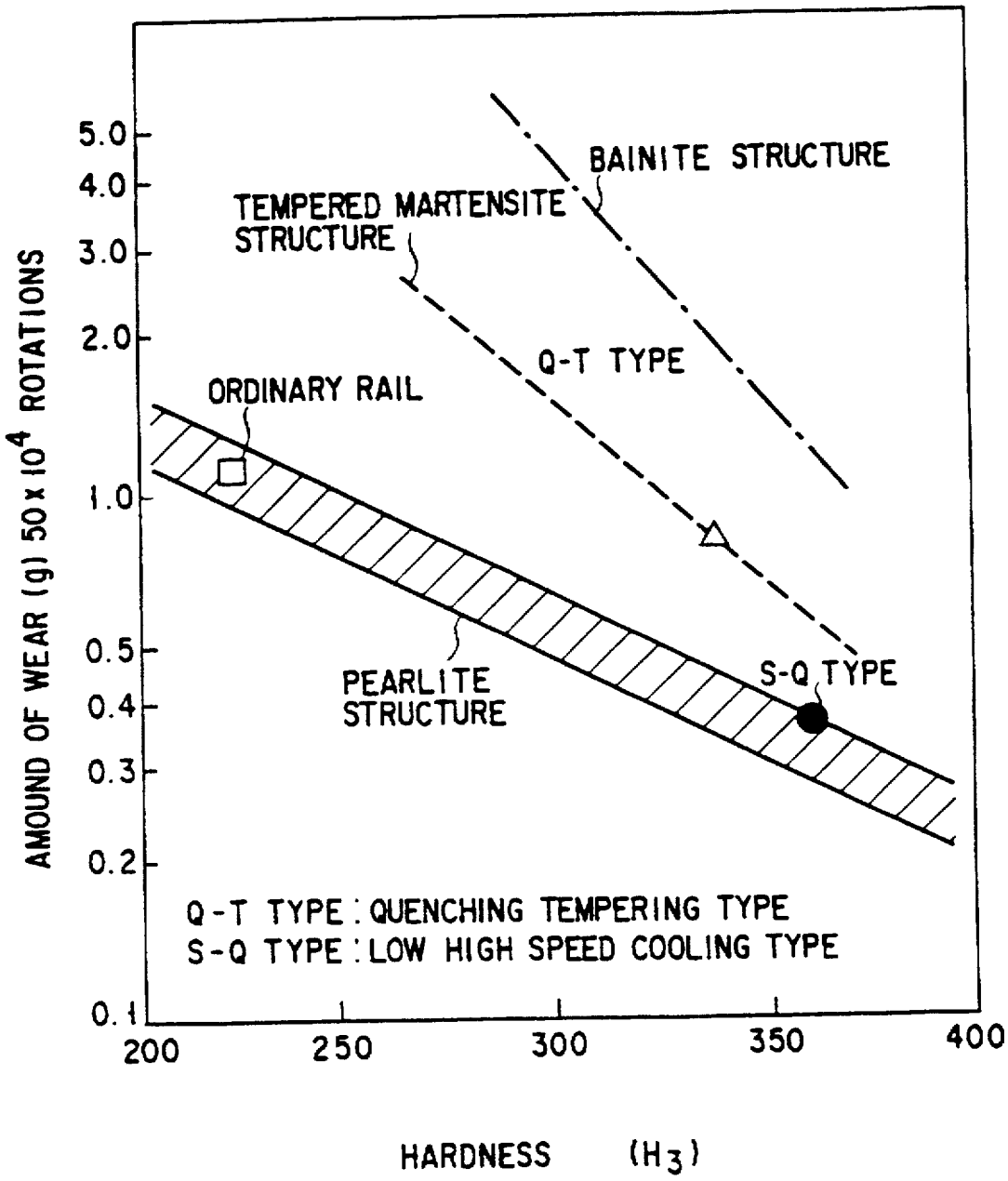
FIG. 5 is a graph, showing the relationship between the hardnesses and the wear amounts of rails.

As is aforementioned, it is known that the conventional rail with a bainite structure has high toughness but low wear resistance. FIG. 5 shows the relationship between the amount of wear and the hardnesses of rails having a pearlite structure, a bainite structure and a tempering martensite structure, respectively. As is evident from FIG. 5, the amount of wear in the bainite structure is larger than that in the pearlite structure. This means that in the conventional bainitic rail of high strength, bainite is employed to enhance the resistance against a rolling fatigue damage at the sacrifice of the resistance against wear. On the other hand, in the present invention, the bainite structure is made to have high hardness, thereby enhancing both its toughness and wear resistance.

According to the fifth embodiment of the present invention, there is provided a rail, which essentially consists of 0.2 to 0.5 wt % of C, 0.1 to 2.0 wt % of Si, 1.0 to 4.0 wt % of Mn, 0.035 wt % or less of P, 0.035 wt % or less of S, 0.3 to 4.0 wt % of Cr, and the balance of iron and inevitable impurities; and has a metal structure of a bainite structure, a hardness greater than 400 Hv at each of a head top portion and a head corner portion thereof, a tensile strength of 1200 MPa or more, and a 2 mm, U-notch Charpy absorbed energy of 30 J or more at +20° C.

The rail constructed as above can be used in high rate transportation railroads or heavy-duty railroads, and in cold districts.

Preferably, the rail further contains at least one selected from the group consisting of 0.1 to 1.0 wt % of Ni and 0.1 to 1.0 wt % of Mo, in light of more increasing its strength. Preferably, the rail further contains at least one selected from the group consisting of 0.01 to 0.1 wt % of Nb and 0.01 to 1.0 wt % of V, in light of further increasing its wear resistance. To increase both the strength and the wear resistance, the rail may contain both the above-described ingredients.

According to the sixth embodiment of the invention, there is provided a rail, which essentially consists of 0.2 to 0.5 wt % of C, 0.1 to 2.0 wt % of Si, 1.0 to 4.0 wt % of Mn, 0.035 wt % or less of P, 0.035 wt % or less of S, 0.3 to 4.0 wt % of Cr, and the balance of iron and inevitable impurities; and has a metal structure of a bainite structure and a hardness of 400 Hv or more at each of a head top portion and a head corner portion thereof.

By virtue of this structure, the rail can have high toughness and wear resistance, and be used in high-rate transportation railroads or heavy-duty railroads.

Also in this case, the rail further preferably containing at least one selected from the group consisting of 0.1 to 1.0 wt % of Ni and 0.1 to 1.0 wt % of Mo, in light of further increasing its strength. Preferably, the rail further contains of at least one selected from the group consisting of 0.01 to 0.1 wt % of Nb and 0.01 to 1.0 wt %r of V, in light of further increasing its wear resistance. To increase both the strength and the wear resistance, the rail may contain both the above-described ingredients.

The reasons why the chemical composition, the microstructure, the hardness, the toughness and manufacturing conditions of the rail are set to the above-described values will be explained.

Re: Chemical Composition 0.2 to 0.5 wt % of C

C is an essential element for securing sufficient strength and wear resistance for a rail steel. If the C content is less than 0.2 wt %, a steel of a hardness suitable for a rail cannot be prepared at low cost. Further, if the C content exceeds 0.5 wt %, the rail head portion cannot have a uniform bainite structure, thereby deteriorating the toughness. In light of the above, the C content is set to 0.2 to 0.5 wt %.

0.1 to 2.0 wt % of Si

Si is an element which is effective not only as a deoxidizer but also an element for increasing the strength and hence the wear resistance by solving ferrite in the bainite structure. If the Si content is less than 0.1 wt %, no effect can be found. If the Si content is more than 2.0 wt %, the steel embrittles. Therefore, the Si content is set to 0.1 to 2.0 wt %.

1.0 to 4.0 wt % of Mn

Mn is an element for increasing the strength of the rail steel by lowering the transformation temperature of bainite to enhance the hardenability. If the Mn content is less than 1.0 wt %, little effect will be found. If the Mn content is more than 4.0 wt %, a martensite structure will easily be formed because of micro segregation of the steel. The martensite structure hardens or embrittles during heating and welding, thereby degrading the steel. Therefore, the Mn content is set to 1.0 to 4.0 wt %.

0.035 wt % or less of P

Since P reduces the toughness, its content is limited to less than 0.035 wt %.

0.035 wt % or less of S

S is contained in the steel, mainly in the form of inclusion. If the S content exceeds 0.035 wt %, the amount of inclusion significantly increases and hence the steel embrittles and degrades. To avoid this, the S content is limited less than 0.035 wt %.

0.3 to 4.0 wt % of Cr

Cr is an element for improving the hardenability of bainite. Cr is a very important element in the steel of the present invention for strengthening the bainite structure as the metal structure. If the Cr content is less than 0.3 wt %, the quenching properties of bainite are degraded, and a microstructure is not formed by a uniform bainite structure. If the Cr content exceeds 4.0 wt %, martensite may easily be formed. Therefore, the Cr content is set to 0.3 to 4.0 wt %.

0.1 to 1.0 wt % of Ni, 0.1 to 1.0 wt % of Mo

Each of Ni and Mo is an element to be solved in bainite for improving the hardenability of bainite and strengthening the same. If the Ni or Ho content is less than 0.1 wt %, no effect can be found. Further, even if the Ni or Ho content exceeds 1.0 wt %, no more effect can be expected. In light of these, it is preferable that each of the Ni and Mo content is set to 0.1 to 1.0 wt %, and at least one of them is added.

0.01 to 0.1 wt % of Nb and 0.01 to 0.1 wt % of V

Since each of Nb and V is bonded with C contained in bainite and deposited after rolling, they are effective elements for increasing the hardness and wear resistance of the head portion of the rail until a deep portion by precipitation hardening occurs, thereby elongating the service life of the rail. If the Nb or V content is less than 0.01 wt %, a sufficient effect cannot be obtained. Further, even if the Nb or V content exceeds 0.1 wt %, no more effect can be expected. In light of the above, it is preferable that each of the Nb and V content is set to 0.01 to 0.1 wt %, and at least one of them is added.

Re: Metal Structure (Microstructure)

In the present invention, the rail has a bainite structure. As compared with the conventional pearlite rail, the bainite structure has a high dislocation density, and accordingly has high strength and high toughness. Therefore, the amount of C can be set smaller than that in the pearlite rail.

Re: Hardness

Any portion of the head top portion and head corner portion of the rail has a hardness of greater than 400 Hv. In the case of the bainitic rail of the invention, if the hardness of the rail is greater than 400 Hv, the amount of wear is less than that of an ordinary rail.

The reason why the hardness is set to the above-described values is based on the relationship between the hardness and the amount of wear.

Although it is most desirable to estimate the amount of wear of a rail actually used, it is also effective to estimate the same from comparison tests in which contact conditions of actually-used rails are simulated using the Nishihara type wear-testing system. The above method can estimate the wear resistance (the relationship between the hardness and the wear loss ratio) in a short time. Hereinbelow, estimation results obtained using the method will be described.

Figure 6:
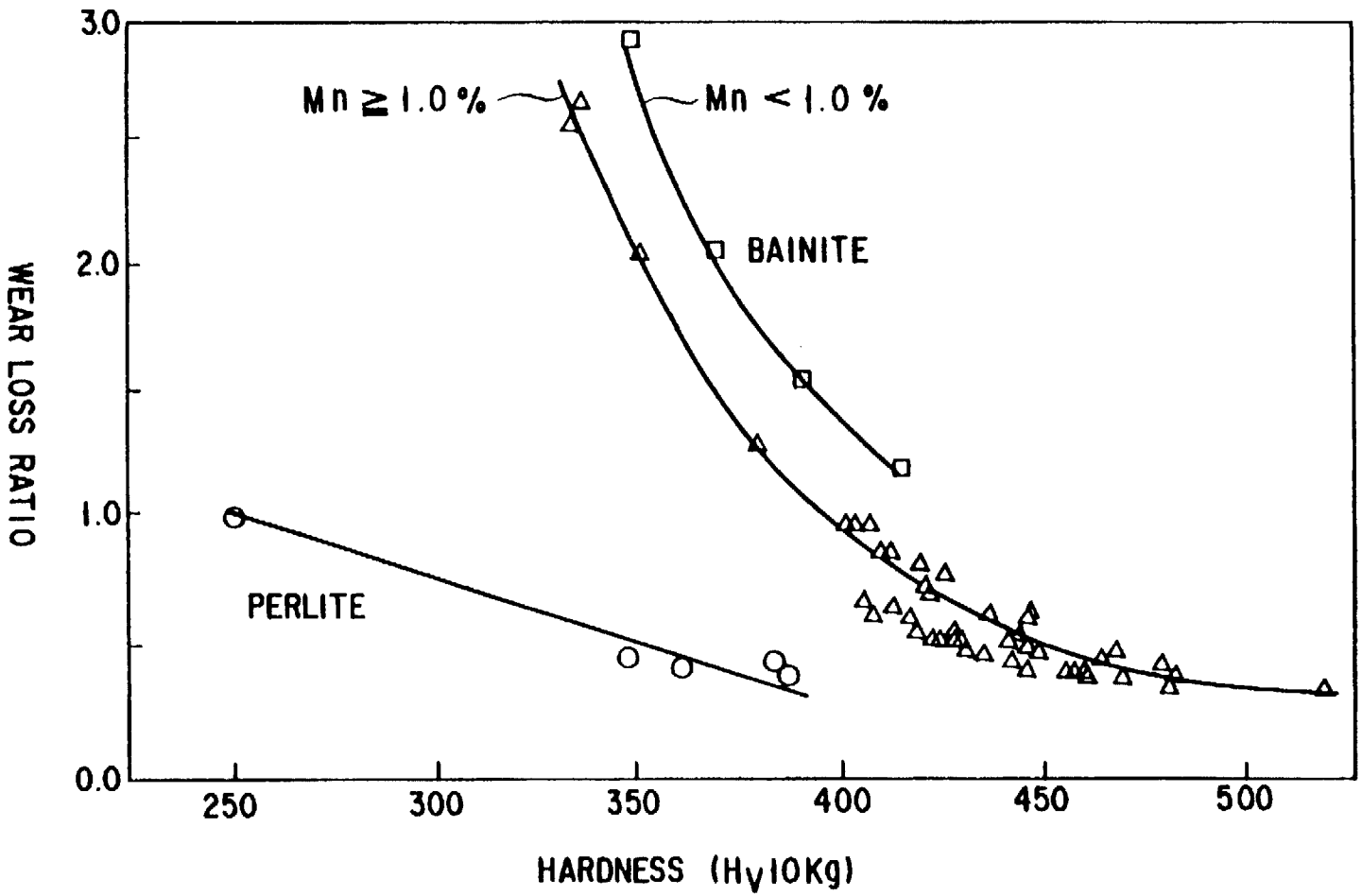
FIG. 6 is a graph, showing the relationship between the hardness and the wear loss ratios of rails.

FIG. 6 shows the influence of the hardness on the wear loss ratio. Steel samples of various compositions as shown in Table 11 and Tables 12, 14, 16, 18 and 20 (which are set forth hereinafter) were prepared by varying the contents of C, Si, Mn, Cr, Ni, Mo, Nb and V. These samples were heated at 1250° C., rolled at 920° C., and acceleratedly cooled at 3° C./sec. so that the rolling finishing temperature and the cooling rate of the invention could be satisfied, thereby forming steel plates of a thickness of 12 mm.

Nishihara type wear test pieces having a diameter of 30 mm and a width of 8 mm, were cut from the steel plates, and were subjected to a wear test carried out under the conditions of a contact load of 50 kg, a slippage ratio of −10%, and no lubricant. The wear loss of each test piece after 500,000 rotations was measured. Estimation was performed on the basis of the ratio of the wear loss of each test piece to the wear loss of an ordinary rail.

The hardness of an ordinary rail having a pearlite structure is about 250 Hv. As can be understood from FIG. 6, the wear loss ratio decreases in accordance with an increase in hardness, and at the same hardness, the bainite structure had a greater wear loss ratio than the pearlite structure. As regards the bainite structure, at the same hardness, bainite containing 1.0 wt % or more of Mn has a lower wear loss ratio than that containing less than 1.0 wt % of Mn. Specifically, the wear loss ratio of each steel in Table 5 which contains less than 1.0 wt % of Mn is higher than that of each steel in Tables 12, 14, 16, 18 and 20, which contains 1.0 wt % or more of Mn.

This is probably because an increase in Mn content reduces the bainite transformation temperature, thereby narrowing the width of the lath of bainite and hence enhancing the wear resistance. Further, in the case of containing 1.0 wt % or more of Mn, the wear loss ratio of the bainite structure is equal to or less than that of the usual rail when its hardness is greater than 400 Hv. Thus, if the content of Mn is 1.0 wt % or more and the hardness is greater than 400 Hv, the bainite structure of the invention can have a wear resistance equal to or more than that of the ordinary rail, and can be put to commercial use.

Although in the aforesaid fifth and sixth embodiments of the invention, it suffices if the hardness is greater than 400 Hv, the hardness is preferably 500 Hv or less to effectively prevent delayed fracture.

TABLE 5

| | Chemical Composition (wt %) | | | | | | Hardness | Wear Loss |
|---|---|---|---|---|---|---|---|---|
| Sample | C | Si | Mn | P | S | Cr | (Hv) | Ratio |
| A-1 | 0.31 | 0.33 | 0.41 | 0.011 | 0.008 | 3.03 | 347 | 2.91 |
| A-2 | 0.30 | 0.32 | 0.60 | 0.011 | 0.008 | 2.53 | 369 | 2.07 |
| A-3 | 0.41 | 0.32 | 0.39 | 0.011 | 0.008 | 1.52 | 390 | 1.55 |
| A-4 | 0.29 | 0.32 | 0.82 | 0.010 | 0.007 | 2.50 | 414 | 1.21 |

Re: Strength and Toughness

In the case of using the rail of the present invention in cold districts, it is necessary to set the tensile strength to 1200 MPa or more, the 2 mm, U-notch Charpy absorbed energy to 30 J or more at +20° C. These conditions are satisfied in the first embodiment of the invention. However, it is not always necessary to satisfy the conditions in districts other than cold ones.

Re: Manufacturing Conditions

In order to form the above-described bainite structure of a steel having a composition as above and obtain the above-described rail properties, the steel of the composition is hot-rolled to have a finishing temperature of 800°–1000° C., and is cooled at a cooling rate of 5° C./sec. or less between a bainite transformation-starting temperature or more and 400° C. or less.

If the rolling finishing temperature is less than 800° C., bainite transformation will start disadvantageously during rolling, thereby significantly reducing the strength. Moreover, if the rolling finishing temperature is more than 1000° C., austenite grains are enlarged, making it difficult to secure a predetermined toughness after hot rolling. In light of these facts, the rolling finishing temperature is set to 800°–100° C.

As regards the cooling rate, the bainite structure having a desired strength and a desired toughness can be obtained even by air cooling. If, however, the cooling rate exceeds 5° C./sec., martensite will appear and reduce the toughness. Therefore, the cooling rate is set to 5° C. or less.

It is preferable to perform on-line cooling in which the bainite structure is cooled on a rolling line immediately after it is rolled on the same line. The on-line cooling is advantageous in thermal efficiency, as compared with a treatment in which the bainite structure is cooled to a room temperature after hot rolling and then reheated.

In the rail manufactured by the above-described method, each of the head top portion and the head corner portion has a hardness of greater than 400 Hv, and a tensile strength of 1200 MPa or more, and a 2 mm, U-notch Charpy absorbed energy of 30 J or more at +20° C. The rail constructed as above can be used in high-speed transportation railroads or heavy-duty railroads, or in cold districts.

EXAMPLES

The present invention will be described in detail by way of the following examples.

Example 1

Steel samples having compositions, microstructures, and hardnesses shown in Table 6 were subjected to an abrasion test. In this abrasion test, test pieces each having an outer diameter of 30 mm and a width of 8 mm were sampled from the steel samples, and wheel test pieces each having the same size as that of each rail test piece were sampled from the material of railroad wheels. Each rail test piece was brought into contact with each wheel test piece using a Nishihara type abrasion tester under the conditions that the contact load was 135 kg, the slip ratio was −10%, and a lubricant was not used, which conditions were reported as the contact conditions in an existing railroad. In this case, the ratio of the abrasion loss amount of each rail test piece to that of a plain rail material as a control was calculated, and abrasion of the rail test piece was evaluated using this abrasion loss ratio. Results are summarized in Table 6. Whether an accelerated cooling in the manufacture of the steel samples was performed or not performed was also summarized in Table 5.

As shown in Table 6, as for samples E-4, E-7, and E-9 each having a pearlite structure, the hardnesses Hv of samples E-4 and E-9 are 250 and 350, respectively, which satisfy the range of the present invention, but have abrasion loss ratios as low as 1.00 and 0.05, respectively. Although sample E-7 has a high abrasion loss ratio of 1.40, it has a hardness Hv of 200 which is lower than the lower limit of the range of the present invention. Therefore, samples E-4, E-7, and E-9 are impractical.

To the contrary, samples E-1, E-2, E-3, E-5, E-6, and E-8 exhibit bainite structures. Among them all, sample E-2 has a Cr content of 0.05% which is lower than the lower limit of the range of the present invention. For this reason, sample E-2 has a hardness Hv as low as 230 and an excessively high abrasion loss ratio of 3.58. Sample E-6 has an Mn content of 3.05% which exceeds the upper limit of the range of the present invention. Sample E-6 has a hardness Hv as high as 420 and an abrasion loss ratio of 1.20 lower than 1.3 which is the lower limit of the appropriate abrasion wear range. Samples E-1, E-3, E-5, and E-8 having bainite structures and components all of which fall within the range of the present invention have hardnesses falling within the range of the present invention. These samples have appropriate abrasion loss amounts falling within the range of 1.3 to 3.0.

TABLE 6

| | Chemical Components (wt %) | | | | | Accelerated | Micro-struc- | Hardness | Abrasion Loss Ratio (with respect to conventional | |
|---|---|---|---|---|---|---|---|---|---|---|
| No. | C | Si | Mn | Cr | Mo | cooling | ture | (Hv) | rail) | Remarks |
| E-1 | 0.31 | 0.29 | 0.44 | 2.41 | 0.02 | not performed | Bainite | 300 | 1.69 | Present Invention |
| E-2 | 0.15 | 0.40 | 0.50 | 0.05 | 1.15 | performed | Bainite | 230 | 3.58 | Comparative Example |
| E-3 | 0.18 | 0.15 | 2.00 | 0.70 | 0.09 | performed | Bainite | 275 | 2.02 | Present Invention |
| E-4 | 0.75 | 0.18 | 1.00 | 0.20 | 0.03 | performed | Pearlite | 350 | 0.95 | Comparative Example |
| E-5 | 0.16 | 0.30 | 0.46 | 0.35 | 1.25 | not performed | Bainite | 250 | 2.85 | Present Invention |
| E-6 | 0.50 | 0.35 | 3.05 | 0.80 | 0.03 | performed | Bainite | 420 | 1.20 | Comparative Example |
| E-7 | 0.65 | 0.50 | 0.50 | 0.50 | 1.04 | not performed | Pearlite | 200 | 1.40 | Comparative Example |
| E-8 | 0.44 | 0.15 | 2.49 | 0.72 | 0.03 | performed | Bainite | 370 | 1.35 | Present Invention |
| E-9 | 0.70 | 0.30 | 0.95 | — | — | not performed | Pearlite | 250 | 1.00 | Comparative Example |

Example 2

Steel samples having compositions, microstructures, and hardnesses shown in Table 7 were subjected to an abrasion test following the same procedures as in Example 1. Abrasion loss ratios are also summarized in Table 7. Whether an accelerated cooling in the manufacture of the steel samples was performed or not performed was also summarized in Table 7. Note that all the steel samples exhibited bainite structure.

As shown in Table 7, samples F-1, F-4, and F-7 whose Mn, Cr, or Mn contents are lower than the lower limits of the ranges of the present invention have low hardnesses and abrasion loss ratios as high as 3.0 or more. Samples F-3, F-6, and F-9 whose Mn,° Cr, or Mo contents are higher than the upper limits of the ranges of the present invention have very high hardnesses and abrasion loss ratios of less than 1.3. To the contrary, samples F-2, F-5, and F-8 whose Mn, Cr, and Mo contents fall within the ranges of the present invention have hardnesses which fall within the ranges of the present invention, and abrasion lose ratios of 1.3 to 3.0 which are suitable values.

TABLE 7

| No. | Chemical Components (wt %) C | Si | Mn | Cr | Mo | Accelerated cooling | Micro-structure | Hardness (Hv) | Abrasion Loss Ratio (with respect to conventional rail) | Remarks |
|---|---|---|---|---|---|---|---|---|---|---|
| F-1 | 0.16 | 0.10 | 0. | 2.80 | 0.09 | not performed | Bainite | 180 | 4.51 | Comparative Example |
| F-2 | 0.20 | 0.25 | 2.30 | 0.90 | 0.35 | performed | Bainite | 300 | 1.82 | Present Invention |
| F-3 | 0.34 | 0.31 | 4.68 | 1.05 | 0.05 | performed | Bainite | 415 | 0.94 | Comparative Example |
| F-4 | 0.44 | 0.43 | 0.79 | 0.01 | 1.02 | performed | Bainite | 194 | 4.28 | Comparative Example |
| F-5 | 0.19 | 0.51 | 1.35 | 0.75 | 0.04 | performed | Bainite | 320 | 1.43 | Present Invention |
| F-6 | 0.23 | 0.61 | 1.80 | 4.71 | 0.04 | performed | Bainite | 423 | 1.15 | Comparative Example |
| F-7 | 0.38 | 0.79 | 0.16 | 0.42 | — | not performed | Bainite | 218 | 3.74 | Comparative Example |
| F-8 | 0.40 | 0.75 | 0.67 | 0.35 | 1.22 | not performed | Bainite | 285 | 2.68 | Present Invention |
| F-9 | 0.41 | 0.81 | 3.44 | 5.84 | 2.51 | performed | Bainite | 426 | 1.04 | Comparative Example |

Example 3

Steel samples having compositions, microstructures, and hardnesses shown in Table 8 were subjected to an abrasion test following the same procedures as in Example 1. Abrasion loss ratios are also summarized in Table 8. In Example 3, in addition to the abrasion loss ratios, the thicknesses of white layers were also measured. The thickness of each white layer was measured as follows. A columnar test piece having a diameter of 3 mm was sampled from each steel sample, the columnar test piece was set on the side of the Nishihara type rolling fatigue tester where a rail sample was attached, and a wheel test piece was spontaneously brought into contact with the rail test piece to cause forced slip to rapidly heat and cool the test piece, thereby simulating formation of a white layer. The thickness of the resultant white layer was measured. Results are also summarized in Table 8. Whether an accelerated cooling in the manufacture of the steel samples was performed or not performed was also summarized in Table 8. Note that the contents of components, i.e., C, Si, Mn, and Cr of the steel samples for samples G-1, G-3, G-5, G-7, and G-9 were set equal or substantially equal to those for samples G-2, G-4, G-6, G-8, and G-10, respectively. Also note that the contents of components, i.e., V, Nb, and Ti of the steel samples for samples G-1, G-3, G-5, G-7, and G-9 were set to fall within the ranges of the present invention, while those for samples G-2, G-4, G-6, G-8, and G-10 were set to fall outside the ranges of the present invention.

As can be apparent from Table 8, samples G-1 to G-10 have bainite structure, and hardnesses and abrasion loss ratios which fall within the ranges of the present invention. The thicknesses of white layers hardly change even if V, Nb, and Ti are added exceeding the ranges of the present invention. No effectiveness is found even if V, Nb, and Ti are added exceeding the ranges of the present invention, only resulting in an increase in cost.

TABLE 8

| No. | Chemical Components (wt %) C | Si | Mn | Cr | Mo | V | Nb | Ti | Accelerated cooling | Micro-structure | Hardness (Hv) | Abrasion Loss Ratio | Thickness of White Layer (μm) | Remarks |
|---|---|---|---|---|---|---|---|---|---|---|---|---|---|---|
| G-1 | 0.31 | 0.29 | 0.44 | 0.61 | 1.25 | 0.021 | — | — | not performed | Bainite | 357 | 1.41 | 170 | Present Invention |
| G-2 | 0.30 | 0.30 | 0.45 | 0.59 | 1.27 | 0.085 | — | — | not performed | Bainite | 356 | 1.42 | 169 | Comparative Example |
| G-3 | 0.18 | 0.15 | 2.00 | 0.71 | 0.35 | 0.019 | — | — | performed | Bainite | 326 | 1.67 | 135 | Present Invention |
| G-4 | 0.19 | 0.18 | 2.02 | 0.72 | 0.33 | 0.077 | — | — | performed | Bainite | 329 | 1.65 | 133 | Comparative Example |
| G-5 | 0.16 | 0.30 | 1.55 | 1.35 | 0.62 | 0.027 | 0.007 | — | performed | Bainite | 344 | 1.54 | 91 | Present Invention |
| G-6 | 0.15 | 0.30 | 1.54 | 1.35 | 0.64 | 0.028 | 0.051 | — | performed | Bainite | 346 | 1.55 | 90 | Comparative Example |
| G-7 | 0.29 | 0.50 | 0.50 | 2.34 | 0.42 | 0.043 | — | 0.002 | not performed | Bainite | 310 | 2.01 | 125 | Present Invention |
| G-8 | 0.30 | 0.51 | 0.51 | 2.33 | 0.43 | 0.041 | — | 0.034 | not performed | Bainite | 309 | 1.98 | 123 | Comparative Example |
| G-9 | 0.33 | 0.25 | 0.43 | 2.86 | 0.51 | 0.026 | 0.006 | 0.006 | not performed | Bainite | 315 | 1.54 | 142 | Present Invention |
| G-10 | 0.34 | 0.23 | 0.41 | 2.89 | 0.50 | 0.028 | 0.008 | 0.017 | not performed | Bainite | 318 | 1.56 | 143 | Comparative Example |

Example 4

Steel samples having compositions, microstructures, and hardnesses shown in Table 9 were subjected to an abrasion test following the same procedures as in Example 1. Abrasion loss ratios are also summarized in Table 9. Whether an accelerated cooling in the manufacture of the steel samples was performed or not performed was also summarized in Table B. The microstructures of the steel samples whose Hv exceeded 400 were partial mixed structures of bainite and martensite. Note that M+B in the column of microstructure in Table 9 represents a mixed structure of martensite and bainite.

As shown in Table 9, samples H-1, H-3, H-5, H-7, H-9, H-11, and H-13 having at least one of the Cu and Ni contents satisfying the ranges of the present invention have hardnesses Hv of 271 to 335 all of which fall within the range of the present invention. These samples have abrasion loss ratios of 1.43 to 2.84 all of which satisfy the appropriate range. However, samples H-2, H-6, and H-10 in all of which the Cu contents of the alloy elements exceed the range of the present invention and samples H-4, H-8, H-12, and H-14 whose Ni contents exceed the range of the present invention have hardnesses Hv of 400 or more and abrasion loss ratios of less than 1.3.

ranges of the present invention, exhibited decreases in internal hardness almost equal to those of samples I-3, I-S, and I-7 whose components fall within the ranges of the present invention. It is found that the effect obtained upon addition of Nb and Ti in large amounts is saturated.

Samples I-9, I-11, I-13, and I-15 have C, Si, Mn, Cr, and Mo contents almost equal to those of samples I-10, I-12, I-14, and I-16, respectively. These samples were checked when Cu and Ni were added singly or in a combination. Samples I-10, I-12, I-14, and I-16 whose Cu and Ni contents exceed the ranges of the present invention have decreases in internal hardness almost equal to those of samples I-9, I-11, I-13, and I-15 whose Cu and Ni contents fall within the ranges of the present invention but have martensite-bainite mixed structures in which martensite which becomes the start point of a damage is formed on the surface layer.

TABLE 9

| No. | Chemical Components (wt %) C | Si | Mn | Cr | Cu | Ni | Mo | Accelerated Cooling | Micro-structure | Hardness (Hv) | Abrasion Loss Ratio (with respect to conventional rail) | Remarks |
|---|---|---|---|---|---|---|---|---|---|---|---|---|
| H-1 | 0.16 | 0.10 | 0.41 | 2.80 | 0.44 | — | 0.44 | not performed | Bainite | 295 | 1.81 | Present Invention |
| H-2 | 0.20 | 0.25 | 0.50 | 0.80 | 2.25 | — | 1.31 | performed | M + B | 430 | 1.02 | Comparative Example |
| H-3 | 0.34 | 0.31 | 0.68 | 1.05 | — | 0.70 | 1.00 | performed | Bainite | 290 | 1.55 | Present Invention |
| H-4 | 0.44 | 0.43 | 0.79 | 0.94 | — | 3.20 | 1.05 | performed | M + B | 442 | 0.95 | Comparative Example |
| H-5 | 0.19 | 0.51 | 1.35 | 0.75 | 0.08 | — | 0.94 | performed | Bainite | 320 | 1.43 | Present Invention |
| H-6 | 0.23 | 0.61 | 1.80 | 0.71 | 2.05 | — | 0.77 | performed | Bainite | 423 | 1.15 | Comparative Example |
| H-7 | 0.38 | 0.79 | 2.43 | 0.76 | 0.50 | 0.50 | 0.31 | not performed | Bainite | 271 | 2.84 | Present Invention |
| H-8 | 0.40 | 0.75 | 0.67 | 1.03 | 1.20 | 2.51 | 0.29 | not performed | Bainite | 412 | 1.17 | Comparative Example |
| H-9 | 0.41 | 0.81 | 0.44 | 0.84 | 1.49 | — | 0.15 | performed | Bainite | 335 | 1.44 | Present Invention |
| H-10 | 0.22 | 0.32 | 0.56 | 1.14 | 2.51 | — | 0.13 | performed | M + B | 445 | 0.92 | Comparative Example |
| H-11 | 0.29 | 0.45 | 0.81 | 1.06 | — | 0.36 | 0.67 | performed | Bainite | 280 | 2.25 | Present Invention |
| H-12 | 0.32 | 0.92 | 2.12 | 0.92 | — | 3.03 | 0.64 | not performed | Bainite | 401 | 1.04 | Comparative Example |
| H-13 | 0.30 | 0.28 | 0.61 | 0.91 | 1.54 | 0.98 | 1.15 | not performed | Bainite | 290 | 2.12 | Present Invention |
| H-14 | 0.35 | 0.27 | 0.51 | 0.82 | 1.58 | 2.88 | 1.08 | not performed | Bainite | 398 | 1.25 | Comparative Example |

* M + B represents a mixing texture of martensite and bainite.

Example 5

Steel samples having the compositions in Table 10 were rolled into a rail shape, and air cooling or accelerated cooling was performed after rolling. The surface hardnesses Hv of these steel samples were measured at the head top surfaces of the respective rolled material with a load of 10 kg. The internal hardness Hv of each sample at a position 30 mm deep from the head top surface was measured with a load of 10 kg. Abrasion test samples as in Example 1 were sampled from head portions of the rolled materials (bainite layers for steel samples each having a mixed structure of martensite and bainite) to evaluate abrasion loss ratios according to the same test method as in Example 1. The resultant values are summarized in Table 11. Note that whether an accelerated cooling in the manufacture of the steel samples was performed or not performed was also summarized in Table 10. Table 11 shows surface layer structures, and M+B in this column represents martensite+bainite.

Samples I-1 and I-2 were compared with each other in the range of higher V contents while the C, Si, Mn, Cr, and Mo contents are set equal in these samples. Although sample I-2 has a v content exceeding the range of the present invention, sample I-2 has an internal hardness almost equal to that of sample I-1. No effectiveness was found even when V was excessively added.

Samples I-3, I-5, and I-7 have C, Si, Mn, Cr, and Mo contents almost equal to those of samples I-4, 1-6, and I-8, respectively, so as to check the influences derived when Nb and Ti are added singly or in a combination. Samples I-4, I-6, and I-8, in which Nb and Ti are added exceeding the The influence of the Mn content in sample I-17 was compared with that in sample I-18. Sample I-17 whose Mn content falls within the range of the present invention had a surface layer hardness Hv of 379 which satisfies the range of the present invention. Sample I-17 had a small decrease in internal hardness and an abrasion loss ratio of 1.37 which was an appropriate value. However, martensite was produced in the surface layer in sample I-18 because of a high Mn content, and the surface layer was extremely hardened.

The influence of the C content in sample I-19 was compared with that in sample I-20. Sample I-19 whose C content falls within the range of the present invention had a surface layer structure and a surface hardness which fall within the ranges of the present invention. Sample I-19 had an appropriate abrasion loss ratio. However, since sample I-20 has a high C content, martensite was produced in the surface layer, and the surface layer was extremely hardened.

The influence of V, Nb, and Ti contents in sample I-21 was compared with that in sample I-22. When if V, Nb, and Ti was added exceeding the amounts defined in the present invention, the internal hardness was almost equal to that of the steel of the present invention. It was confirmed that the effect obtained upon addition of these elements in large amounts was saturated.

TABLE 10

| No. | C | Si | Mn | Cr | Cu | Ni | Mo | V | Nb | Ti | (wt %) Presence/Absence of Accelerated Cooling |
|---|---|---|---|---|---|---|---|---|---|---|---|
| I-1 | 0.44 | 0.25 | 2.48 | 0.73 | — | — | 0.31 | 0.048 | — | — | performed |
| I-2 | 0.45 | 0.24 | 2.46 | 0.74 | — | — | 0.30 | 0.105 | — | — | performed |
| I-3 | 0.34 | 0.31 | 0.51 | 2.03 | — | — | 0.45 | 0.040 | 0.008 | — | not performed |
| I-4 | 0.33 | 0.33 | 0.52 | 2.01 | — | — | 0.47 | 0.039 | 0.039 | — | not performed |
| I-5 | 0.24 | 0.51 | 1.82 | 0.75 | — | — | 0.37 | 0.045 | — | — | performed |
| I-6 | 0.23 | 0.52 | 1.80 | 0.77 | — | — | 0.36 | 0.044 | — | 0.006 | performed |
| I-7 | 0.19 | 0.40 | 1.10 | 1.53 | — | — | 0.15 | 0.022 | 0.007 | 0.049 | performed |
| I-8 | 0.18 | 0.42 | 1.12 | 1.50 | — | — | 0.14 | 0.021 | 0.021 | 0.009 | performed |
| I-9 | 0.38 | 0.79 | 0.68 | 1.02 | 1.20 | — | 0.44 | 0.015 | — | 0.019 | performed |
| I-10 | 0.40 | 0.77 | 0.67 | 1.05 | 4.20 | — | 0.43 | 0.014 | — | — | performed |
| I-11 | 0.27 | 0.45 | 0.81 | 1.22 | — | 1.97 | 0.98 | 0.022 | — | — | not performed |
| I-12 | 0.28 | 0.44 | 0.83 | 1.20 | — | 4.68 | 1.01 | 0.021 | — | — | not performed |
| I-13 | 0.31 | 0.20 | 2.02 | 0.81 | 0.15 | 0.20 | 0.47 | 0.012 | — | — | performed |
| I-14 | 0.32 | 0.20 | 2.01 | 0.83 | 0.10 | 3.81 | 0.48 | 0.011 | — | — | performed |
| I-15 | 0.16 | 0.13 | 0.42 | 1.95 | 0.20 | 0.50 | 0.65 | 0.018 | — | — | performed |
| I-16 | 0.17 | 0.13 | 0.41 | 1.98 | 8.23 | 0.49 | 0.63 | 0.017 | — | — | performed |
| I-17 | 0.42 | 0.06 | 0.31 | 0.31 | 0.15 | 0.35 | 1.25 | 0.009 | 0.005 | 0.001 | not performed |
| I-18 | 0.40 | 0.08 | 6.04 | 0.32 | 0.13 | 0.33 | 1.24 | 0.008 | 0.007 | 0.001 | not performed |
| I-19 | 0.30 | 0.21 | 0.50 | 2.11 | 0.08 | 0.13 | 0.35 | 0.031 | 0.008 | 0.006 | performed |
| I-20 | 0.78 | 0.20 | 0.49 | 2.13 | 0.06 | 0.12 | 0.32 | 0.028 | 0.007 | 0.007 | performed |
| I-21 | 0.31 | 0.35 | 0.41 | 0.27 | 0.58 | 0.43 | 1.45 | 0.041 | 0.009 | 0.002 | not performed |
| I-22 | 0.32 | 0.36 | 0.42 | 0.25 | 0.56 | 0.45 | 1.47 | 0.040 | 0.080 | 0.054 | not performed |

TABLE 11

| No. | Surface Layer Texture* | Surface Hardness Hv | Internal Hardness Hv | Abrasion Loss Ratio | Remarks |
|---|---|---|---|---|---|
| I-1 | Bainite | 387 | 358 | 1.34 | Present Invention |
| I-2 | Bainite | 388 | 357 | 1.33 | Comparative Example |
| I-3 | Bainite | 354 | 338 | 1.65 | Present Invention |
| I-4 | Bainite | 358 | 338 | 1.64 | Comparative Example |
| I-5 | Bainite | 326 | 297 | 1.84 | Present Invention |
| I-6 | Bainite | 325 | 298 | 1.85 | Comparative Example |
| I-7 | Bainite | 285 | 261 | 2.05 | Present Invention |
| I-8 | Bainite | 284 | 260 | 2.04 | Comparative Example |
| I-9 | Bainite | 375 | 342 | 1.41 | Present Invention |
| I-10 | M + B | 495 | 345 | 1.42 | Comparative Example |
| I-11 | Bainlte | 324 | 295 | 1.76 | Present Invention |
| I-12 | M + B | 457 | 297 | 1.78 | Comparative Example |
| I-13 | Bainite | 346 | 319 | 1.69 | Present Invention |
| I-14 | M + B | 479 | 320 | 1.67 | Comparative Example |
| I-15 | Bainite | 253 | 206 | 2.97 | Present Invention |
| I-16 | M + B | 412 | 208 | 2.95 | Comparative Example |
| I-17 | Bainite | 379 | 348 | 1.37 | Present Invention |
| I-18 | M + B | 502 | 347 | 1.39 | Comparative Example |
| I-19 | Bainite | 350 | 317 | 1.64 | Present Invention |
| I-20 | M + B | 614 | 380 | 0.81 | Comparative Example |
| I-21 | Bainite | 361 | 342 | 1.41 | Present Invention |
| I-22 | Bainite | 362 | 344 | 1.42 | Comparative Example |

*M + B represents a mixing texture of martensite and bainite

In the following description, the drawings and the Tables, $uE_{20}$ represents a 2 mm, U-notch Charpy absorbed energy at +200C.

Example 6

Steel samples having compositions shown in Table 12 were heated to 1250° C., rolled at 920° C., and acceleratedly cooled at 3° C./sec., thereby forming steel plates of a thickness of 12 mm. The steel plates were subjected to a tensile test, a Charpy impact test and a wear test. In the wear test, test pieces having a diameter of 30 mm and a width of 8 mm were cut from the steel plates, and were tested under the conditions of a contact load of 50 kg, a slippage ration of −10%, and no lubricant. The wear loss of each test piece after 500,000 rotations was measured. The ratio of the wear loss of each test piece to the wear loss of an ordinary rail was calculated. Table 13 shows the mechanical properties and the wear loss ratio of each steel sample.

As is shown in FIG. 6, a sample B-1, which has a C content lower than the present invention, has a hardness of 333 Hv lower than the lower limit value of the present invention and a wear loss ratio of 2.64 higher than the invention. Accordingly, the sample B-1 cannot be put to practice.

Samples B-6 and B-7, which have C contents higher than the invention and a pearlite structure, have hardnesses and wear loss ratios falling within target ranges of the present invention. However, they have low toughnesses of $uE_{20}$= 20.5 J and 16.4 J.

On the other hand, samples B-2, B-3, B-4 and B-5, which satisfy the component ranges of the invention, have strengths, toughnesses and wear loss ratios falling within target ranges of the invention.

TABLE 12

| Sample | C | Si | Mn | P | S | (wt %) Cr |
|---|---|---|---|---|---|---|
| B-1 | 0.13 | 0.33 | 2.02 | 0.009 | 0.007 | 2.01 |
| B-2 | 0.21 | 0.33 | 2.03 | 0.011 | 0.008 | 2.03 |
| B-3 | 0.30 | 0.32 | 2.03 | 0.011 | 0.008 | 2.03 |
| B-4 | 0.41 | 0.32 | 2.02 | 0.011 | 0.008 | 2.02 |
| B-5 | 0.49 | 0.32 | 2.04 | 0.010 | 0.007 | 2.00 |
| B-6 | 0.60 | 0.32 | 1.03 | 0.010 | 0.007 | 2.01 |
| B-7 | 0.80 | 0.54 | 0.85 | 0.016 | 0.009 | 2.00 |

TABLE 13

| Sample | TS (MPa) | $uE_{20}$ (J) | Hardness (Hv) | Wear Loss Ratio | Micro-Structure |
|---|---|---|---|---|---|
| B-1 | 1009 | 93.9 | 333 | 2.64 | Bainite |
| B-2 | 1224 | 60.9 | 406 | 0.99 | Bainite |
| B-3 | 1269 | 51.8 | 417 | 0.62 | Bainite |
| B-4 | 1331 | 39.4 | 445 | 0.50 | Bainite |
| B-5 | 1416 | 33.4 | 464 | 0.41 | Bainite |
| B-6 | 1088 | 20.5 | 302 | 1.30 | Pearlite |
| B-7 | 1228 | 16.4 | 348 | 0.46 | Pearlite |

Example 7

Steel samples having compositions shown in Table 14 were processed in the same manner as in Example 6, and resultant steel plates were subjected to the tensile test, the Charpy impact test and the wear test. All the samples had the bainite structure. Table 15 shows the mechanical properties and the wear loss ratio of each steel sample. A sample C-1, which has a Mn content lower than the present invention, has a hardness lower than 400 Hv and a wear loss ratio of 3.15 higher than the present invention.

On the other hand, samples C-2, C-3, C-4, C-5, C-6, C-7 and C-8, which have Mn contents falling within the range of the present invention, have hardnesses of greater than 400 Hv, and wear loss ratios of less than 1. Furthermore, they show excellent tensile strengths of 1200 MPa or more and excellent toughnesses of $uE_{20}$=30 J or more. However, in the case of a sample C-9 having a Mn content higher than the range of the invention, it is found that the Mn effect of increasing the wear resistance is saturated.

TABLE 14

| Sample | C | Si | Mn | P | S | (wt %) Cr |
|---|---|---|---|---|---|---|
| C-1 | 0.31 | 0.34 | 0.31 | 0.008 | 0.007 | 2.51 |
| C-2 | 0.31 | 0.34 | 1.02 | 0.010 | 0.007 | 2.51 |
| C-3 | 0.30 | 0.31 | 1.53 | 0.010 | 0.007 | 2.53 |
| C-4 | 0.30 | 0.31 | 1.99 | 0.010 | 0.007 | 2.53 |
| C-5 | 0.31 | 0.31 | 2.48 | 0.010 | 0.007 | 2.52 |
| C-6 | 0.32 | 0.30 | 3.04 | 0.009 | 0.008 | 2.53 |
| C-7 | 0.31 | 0.31 | 3.50 | 0.009 | 0.007 | 2.52 |
| C-8 | 0.30 | 0.31 | 3.99 | 0.009 | 0.007 | 2.52 |
| C-9 | 0.31 | 0.34 | 4.52 | 0.009 | 0.008 | 2.53 |

TABLE 15

| Sample | TS (MPa) | $uE^{20}$ (J) | Hardness (Hv) | Wear Loss Ratio |
|---|---|---|---|---|
| C-1 | 1122 | 32.4 | 340 | 3.15 |
| C-2 | 1281 | 63.7 | 403 | 0.99 |
| C-3 | 1356 | 61.6 | 411 | 0.88 |
| C-4 | 1428 | 66.8 | 425 | 0.79 |
| C-5 | 1509 | 62.2 | 447 | 0.65 |
| C-6 | 1571 | 60.3 | 468 | 0.53 |
| C-7 | 1613 | 58.8 | 479 | 0.46 |
| C-8 | 1652 | 55.4 | 485 | 0.44 |
| C-9 | 1707 | 48.1 | 506 | 0.48 |

Example 8

Steel samples having compositions shown in Table 16 were processed in the same manner as in Example 6, and resultant steel plates were subjected to the tensile test, the Charpy impact test and the wear test. All the samples had the bainite structure. Table 17 shows the mechanical properties and the wear loss ratio of each steel sample. A sample D-1, which has a Cr content lower than the present invention, has a hardness lower than 400 Hv and a high wear loss ratio of 2.52.

On the other hand, samples D-2, D-3, D-4, D-5, D-6, D-7, D-8, D-9 and D-10, which have Cr contents falling within the range of the present invention, have hardnesses of 400 Hv or greater, and wear loss ratios of less than 1. Furthermore, they show excellent tensile strengths of 1200 MPa or more and excellent toughnesses of $uE_{20}$=30 J or more. However, in the case of a sample D-11 having a Cr content higher than the range of the invention, it is found that the Cr effect of increasing the wear resistance is saturated.

TABLE 16

| Sample | C | Si | Mn | P | S | (wt %) Cr |
|---|---|---|---|---|---|---|
| D-1 | 0.40 | 0.31 | 2.04 | 0.009 | 0.008 | 0.10 |
| D-2 | 0.40 | 0.32 | 2.05 | 0.009 | 0.007 | 0.35 |
| D-3 | 0.41 | 0.32 | 2.02 | 0.011 | 0.007 | 0.57 |
| D-4 | 0.42 | 0.31 | 2.01 | 0.010 | 0.008 | 1.00 |
| D-5 | 0.40 | 0.33 | 2.01 | 0.011 | 0.007 | 1.51 |
| D-6 | 0.41 | 0.32 | 2.02 | 0.011 | 0.008 | 2.02 |
| D-7 | 0.40 | 0.32 | 2.04 | 0.008 | 0.008 | 2.52 |
| D-8 | 0.40 | 0.32 | 2.04 | 0.009 | 0.008 | 3.04 |
| D-9 | 0.42 | 0.32 | 2.03 | 0.010 | 0.007 | 3.49 |
| D-10 | 0.41 | 0.32 | 2.03 | 0.010 | 0.007 | 3.98 |
| D-11 | 0.41 | 0.32 | 2.01 | 0.010 | 0.006 | 4.50 |

TABLE 17

| Sample | TS (MPa) | $uE_{20}$ (J) | Hardness (HV) | Wear Loss Ratio |
|---|---|---|---|---|
| D-1 | 1081 | 31.2 | 332 | 2.52 |
| D-2 | 1212 | 43.8 | 400 | 0.97 |
| D-3 | 1154 | 49.1 | 405 | 0.90 |
| D-4 | 1296 | 48.4 | 411 | 0.78 |
| D-5 | 1339 | 49.8 | 429 | 0.61 |
| D-6 | 1388 | 45.5 | 433 | 0.57 |
| D-7 | 1474 | 49.2 | 448 | 0.52 |
| D-8 | 1564 | 43.7 | 469 | 0.44 |

TABLE 17-continued

| Sample | TS (MPa) | $uE_{20}$ (J) | Hardness (HV) | Wear Loss Ratio |
|---|---|---|---|---|
| D-9 | 1620 | 47.3 | 486 | 0.39 |
| D-10 | 1677 | 46.6 | 502 | 0.36 |
| D-11 | 1701 | 40.2 | 524 | 0.37 |

Example 9

Steel samples having compositions shown in Table 18 were processed in the same manner as in Example 6, and resultant steel plates were subjected to the tensile test, the Charpy impact test and the wear test. All the samples had the bainite structure. Table 19 shows the mechanical properties and the wear loss ratio of each steel sample. A sample E-1, which has a composition of the present invention and in which Ni and Mo are not contained, has a hardness of greater than 400 Hv. Further, it shows a strength, a toughness and a wear loss ratio which fall within the target ranges of the invention.

Steel samples E-2 and E6, which contain less than 0.1 wt % of Ni and Mo, respectively, show substantially the same strength, toughness and wear loss ratio as the sample D-1 containing no Ni and Mo. This means that addition of less than 0.1 wt % of Ni and Mo shows almost no effect. Samples E-3, E-4, E-7, E-8 and E-10, which contain 0.1 to 1.0 wt % of Ni and/or 0.1 to 1.0 wt % of Mo, have hardnesses of greater than 400 Hv, and show excellent strengths, toughnesses and wear loss ratios. In particular, they show strengths higher than the sample E-1. Steel samples E-5 and E-9, which respectively contain more than 1.0 wt % of Ni and Mo, respectively, show substantially the same strength, toughness and wear loss ratio as the samples E-4 and E-8. This means that if the Ni or Mo content exceeds 1.0 wt %, its addition effect is saturated.

TABLE 18

| Sample | C | Si | Mn | P | S | Cr | Ni | (wt %) Mo |
|---|---|---|---|---|---|---|---|---|
| E-1 | 0.41 | 0.32 | 1.02 | 0.011 | 0.007 | 2.02 | — | — |
| E-2 | 0.40 | 0.31 | 1.04 | 0.011 | 0.007 | 2.02 | 0.05 | — |
| E-3 | 0.40 | 0.31 | 1.04 | 0.011 | 0.007 | 2.02 | 0.21 | — |
| E-4 | 0.39 | 0.32 | 1.01 | 0.012 | 0.008 | 2.02 | 0.73 | — |
| E-5 | 0.39 | 0.32 | 1.01 | 0.012 | 0.008 | 2.02 | 1.50 | — |
| E-6 | 0.40 | 0.31 | 1.02 | 0.012 | 0.007 | 2.01 | — | 0.06 |
| E-7 | 0.40 | 0.31 | 1.02 | 0.012 | 0.007 | 2.01 | — | 0.22 |
| E-8 | 0.41 | 0.31 | 1.02 | 0.010 | 0.007 | 2.01 | — | 0.70 |
| E-9 | 0.41 | 0.31 | 1.02 | 0.010 | 0.007 | 2.01 | — | 1.49 |
| E-10 | 0.40 | 0.31 | 1.04 | 0.011 | 0.007 | 2.02 | 0.21 | 0.23 |

TABLE 19

| Sample | TS (MPa) | $uE_{20}$ (J) | Hardness (Hv) | Wear Loss Ratio |
|---|---|---|---|---|
| E-1 | 1378 | 41.8 | 422 | 0.54 |
| E-2 | 1386 | 40.6 | 424 | 0.54 |
| E-3 | 1454 | 41.1 | 435 | 0.47 |
| E-4 | 1569 | 37.8 | 461 | 0.39 |
| E-5 | 1601 | 33.4 | 470 | 0.39 |
| E-6 | 1370 | 42.2 | 419 | 0.56 |
| E-7 | 1438 | 38.3 | 431 | 0.50 |
| E-8 | 1526 | 35.5 | 456 | 0.41 |
| E-9 | 1555 | 34.9 | 558 | 0.41 |
| E-10 | 1481 | 38.6 | 442 | 0.45 |

Steel samples having compositions shown in Table 20 were processed in the same manner as in Example 6, and resultant steel plates were subjected to the tensile test, the Charpy impact test and the wear test. All the samples had the bainite structure. Table 21 shows the mechanical properties and the wear loss ratio of each steel sample. A steel sample F-1, which has a composition of the present invention and in which Nb and V are not contained, has a hardness of greater than 400 Hv. Further, it shows a strength, a toughness and a wear loss ratio which fall within the target ranges of the present invention.

Steel samples F-2, F-3, F-5, F-6 and F-8, which contain 0.01 to 0.1 wt % of Nb and/or Mo, show excellent strength, toughness and wear loss ratio. In particular, their strength and hardness are higher than those of the sample F-1. Steel samples F-4 and F-7, which respectively contain more than 0.1 wt % of Nb and V, show substantially the same strength, toughness and wear loss ratio as the samples F-3 and F-6. This means that if the Nb or V content exceeds 0.1 wt %, its addition effect is saturated.

Moreover, a steel sample F-9, which have Ni, Mo, Nb and V contents falling within the ranges of the present invention, shows excellent strength, toughness and wear loss ratio as compared with the sample E-10 containing Ni and Mo and the sample F-8 containing Nb and V.

TABLE 20

| Sample | C | Si | Mn | P | S | Cr | Ni | Mo | Nb | (wt %) V |
|---|---|---|---|---|---|---|---|---|---|---|
| F-1 | 0.30 | 0.31 | 1.53 | 0.010 | 0.007 | 2.53 | — | — | — | — |
| F-2 | 0.32 | 0.32 | 1.51 | 0.012 | 0.008 | 2.52 | — | — | 0.03 | — |
| F-3 | 0.32 | 0.32 | 1.51 | 0.012 | 0.008 | 2.52 | — | — | 0.08 | — |
| F-4 | 0.32 | 0.32 | 1.51 | 0.012 | 0.008 | 2.52 | — | — | 0.15 | — |
| F-5 | 0.31 | 0.31 | 1.51 | 0.010 | 0.008 | 2.53 | — | — | — | 0.03 |
| F-6 | 0.31 | 0.31 | 1.50 | 0.010 | 0.008 | 2.53 | — | — | — | 0.10 |

TABLE 20-continued

| Sample | C | Si | Mn | P | S | Cr | Ni | Mo | Nb | (wt %) V |
|---|---|---|---|---|---|---|---|---|---|---|
| F-7 | 0.31 | 0.31 | 1.50 | 0.010 | 0.008 | 2.53 | — | — | — | 0.20 |
| F-8 | 0.32 | 0.32 | 1.51 | 0.011 | 0.008 | 2.51 | — | — | 0.09 | 0.09 |
| F-9 | 0.32 | 0.31 | 1.51 | 0.011 | 0.008 | 2.51 | 0.20 | 0.19 | 0.09 | 0.09 |

TABLE 21

| Sample | TS (MPa) | $uE_{20}$ (J) | Hardness (Hv) | Wear Loss Ratio |
|---|---|---|---|---|
| F-1 | 1356 | 61.6 | 411 | 0.88 |
| F-2 | 1400 | 60.1 | 419 | 0.84 |
| F-3 | 1471 | 63.9 | 441 | 0.53 |
| F-4 | 1503 | 59.4 | 446 | 0.51 |
| F-5 | 1406 | 58.2 | 421 | 0.74 |
| F-6 | 1512 | 61.3 | 448 | 0.50 |
| F-7 | 1571 | 55.6 | 464 | 0.47 |
| F-8 | 1558 | 55.6 | 460 | 0.42 |
| F-9 | 1634 | 44.8 | 483 | 0.40 |

Example 10

Table 22 shows steel samples G-1 and G-2. A rail stock was prepared by hot rolling the samples to the actual shape of a rail, with the rolling finishing temperature varied from 760° to 1030° C. Thereafter, the rail stock was cooled with the cooling conditions varied from air cooling to accelerated cooling of 6.5° C./sec., thereby forming a rail. Table 23 shows the manufacturing conditions.

Table 23 also shows the tensile properties, the 2 mm, U-notch Charpy absorbed energy at +20° C, the hardness and the wear loss ratio of each rail sample manufactured as above. The wear loss ratio was estimated by subjecting the wear test samples in Example 6 extracted from the rolling material head portion, to the same test as in Example 6.

Under conditions 1 which satisfied the cooling rate but did not satisfy the rolling finishing temperature, the sample showed a low tensile strength of 1068 MPa and a high wear loss ratio of 3.11 (a hardness of 320 Hv). Under conditions 2–6, 8–10 and 12 which satisfied both the cooling rate and the rolling finishing temperature, the samples showed excellent values, i.e. a hardness of greater than 400 Hv, a wear loss ratio of 1 or less, a tensile strength of 1200 MPa or more and a toughness of $uE_{20}$=30 J or more.

Under conditions 7, 11 and 13 which satisfied the rolling finishing temperature but did not satisfy the cooling rate, the samples showed low toughnesses of $uE_{20}$=23.0 J, 28.5 J and 21.1 J, respectively.

Under conditions 14 and 15 which satisfied the cooling rate but did not satisfy the rolling finishing temperature, the samples showed low toughnesses of $uE_{20}$=28.9 J and 22.0 J, respectively.

TABLE 22

| Steel | C | Si | Mn | P | s | (wt %) Cr |
|---|---|---|---|---|---|---|
| G-1 | 0.29 | 0.34 | 1.52 | 0.011 | 0.007 | 2.31 |
| G-2 | 0.40 | 0.33 | 1.03 | 0.011 | 0.007 | 2.04 |

TABLE 23

| Conditions No. | Steel | Rolling Temperature (°C.) | Cooling Rate (°C/s) | TS (MPa) | $uE_{20}$ (J) | Hardness (Hv) | Wear Loss Ratio |
|---|---|---|---|---|---|---|---|
| 1 | G-1 | 760 | Air Cooling | 1068 | 32.8 | 320 | 3.11 |
| 2 | G-1 | 820 | Air Cooling | 1207 | 84.4 | 401 | 0.99 |
| 3 | G-2 | 820 | 2.9 | 1309 | 47.3 | 413 | 0.66 |
| 4 | G-2 | 870 | Air Cooling | 1246 | 46.2 | 406 | 0.68 |
| 5 | G-1 | 870 | 2.0 | 1310 | 62.2 | 410 | 0.87 |
| 6 | G-1 | 870 | 3.2 | 1341 | 56.6 | 419 | 0.83 |
| 7 | G-2 | 870 | 6.3 | 1421 | 23.0 | 430 | 0.53 |
| 8 | G-2 | 920 | Air Cooling | 1285 | 52.9 | 408 | 0.63 |
| 9 | G-2 | 920 | 3.1 | 1378 | 41.8 | 422 | 0.54 |
| 10 | G-1 | 920 | 4.9 | 1426 | 55.3 | 436 | 0.65 |
| 11 | G-1 | 920 | 6.5 | 1476 | 28.5 | 444 | 0.55 |
| 12 | G-2 | 970 | 3.1 | 1391 | 36.4 | 428 | 0.57 |
| 13 | G-1 | 970 | 6.2 | 1494 | 21.1 | 446 | 0.63 |
| 14 | G-1 | 1030 | Air Cooling | 1372 | 28.9 | 421 | 0.73 |
| 15 | G-2 | 1030 | 2.9 | 1436 | 22.0 | 428 | 0.53 |

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

We claim:

1. A high-abrasion bainite rail excellent in resistance to rolling fatigue damage, said rail consisting essentially of 0.15 to 0.45 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.05 wt % of Mo, and the balance being iron and inevitable impurities, said rail having a head portion with a head top portion and a head corner portion, said head portion having a uniform bainite structure, and a Vickers hardness, Hv, at any position of said head top portion and said head corner portion of said rail being 240 to 400, said rail having a uniform hardness over the entire head top portion and head corner portion.

2. A high-abrasion bainite rail excellent in resistance to rolling fatigue damage, said rail consisting essentially of 0.15 to 0.45 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.0 wt % of Mo, at least one element selected from the group consisting of 0.005 to 0.01 wt % of Nb, 0.005 to 0.05 wt % of V, and 0.001 to 0.01 wt % of Ti, and the balance being iron and inevitable impurities, said rail having a head portion with a head top portion and a head corner portion, said head portion having a uniform bainite structure, and a Vickers hardness, Hv, at any position of said head top portion and said head corner portion of said rail being 240 to 400, said rail having a uniform hardness over the entire head top portion and head corner portion.

3. A high-abrasion bainite rail excellent in resistance to rolling fatigue damage, said rail consisting essentially of 0.15 to 0.45 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.05 wt % of Mo, at least one element selected from the group consisting of 0.05 to 2.0 wt % of Cu and 0.05 to 2.0 wt % of Ni, and the balance being iron and inevitable impurities, said rail having a head portion with a head top portion and a head corner portion, said head portion having a uniform bainite structure, and a Vickers hardness, Hv, at any position of said head top portion and said head corner portion of said rail being 240 to 400, said rail having a uniform hardness over the entire head top portion and head corner portion.

4. A high-abrasion bainite rail excellent in resistance to rolling fatigue damage, said rail consisting essentially of 0.15 to 0.45 wt % of C, 0.05 to 1.0 wt % of Si, 0.1 to 2.5 wt % of Mn, 0.03 wt % or less of P, 0.03 wt % or less of S, 0.1 to 3.0 wt % of Cr, 0.005 to 2.0 wt % of Mo, at least one element selected from the group consisting of 0.005 to 0.01 wt % of Nb, 0.005 to 0.05 wt % of V, and 0.001 to 0.01 wt % of Ti, at least one element selected from the group consisting of 0.05 to 2.0 wt % of Cu and 0.05 to 2.0 wt % of Ni, and the balance being iron and inevitable impurities, said rail having a head portion with a head top portion and a head corner portion, said head portion having a uniform bainite structure, and a Vickers hardness, Hv, at any position of said head top portion and said head corner portion of said rail being 240 to 400, said rail having a uniform hardness over the entire head top portion and head corner portion.

5. The bainite rail of claim 1, wherein said rail has a composition selected from the group consisting of (a) 0.31 wt % C, 0.29 wt % Si, 0.44 wt % Mn, 2.41 wt % Cr, 0.02 wt % Mo with the balance being iron and inevitable impurities, (b) 0.18 wt % C, 0.15 wt % Si, 2.00 wt % Mn, 0.70 wt % Cr, 0.09 wt % Mo with the balance being iron and inevitable impurities, (c) 0.16 wt % C, 0.30 wt % Si, 0.46 wt % Mn, 0.35 wt % Cr, 1.25 wt % Mo with the balance being iron and inevitable impurities, (d) 0.44 wt % C, 0.15 wt % Si, 2.49 wt % Mn, 0.72 wt % Cr, 0.03 wt % Mo with the balance being iron and inevitable impurities, (e) 0.20 wt % C, 0.25 wt % Si, 2.30 wt % Mn, 0.90 wt % Cr, 0.35 wt % Mo with the balance being iron and inevitable impurities, (f) 0.19 wt % C, 0.51 wt % Si, 1.35 wt % Mn, 0.75 wt % Cr, 0.04 wt % Mo with the balance being iron and inevitable impurities, and (g) 0.40 wt % C, 0.75 wt % Si, 0.67 wt % Mn, 0.35 wt % Cr, 1.22 wt % Mo with the balance being iron and inevitable impurities.

6. The bainite rail of claim 1, wherein the rail has an abrasion loss ratio of 1.3 to 3.0.

7. The bainite rail of claim 2, wherein said rail has a composition selected from the group consisting of (a) 0.31 wt % C, 0.29 wt % Si, 0.44 wt % Mn, 0.61 wt % Cr, 1.27 wt % Mo, 0.021 wt % V with the balance being Fe and inevitable impurities, (b) 0.18 wt % C, 0.15 wt % Si, 2.00 wt % Mn, 0.71 wt % Cr, 0.35 wt % Mo, 0.019 wt % V with the balance being Fe and inevitable impurities, (c) 0.16 wt % C, 0.30 wt % Si, 1.55 wt % Mn, 1.35 wt % Cr, 0.62 wt % Mo, 0.027 wt % V, 0.007 wt % Nb with the balance being Fe and inevitable impurities, (d) 0.29 wt % C, 0.50 wt % Si, 0.50 wt % Mn, 2.34 wt % Cr, 0.42 wt % Mo, 0.043 wt % V, 0.002 wt % Ti with the balance being Fe and inevitable impurities, and (e) 0.33 wt % C, 0.25 wt % Si, 0.43 wt % Mn, 2.86 wt % Cr, 0.51 wt % Mo, 0.026 wt % V, 0.006 wt % Nb, 0.006 wt % Ti with the balance being Fe and inevitable impurities.

8. The bainite rail of claim 2, wherein the rail has an abrasion loss ratio of 1.41 to 2.01.

9. The bainite rail of claim 2, wherein the rail has a white layer with a thickness of 91 to 170.

10. The bainite rail of claim 3, wherein the rail has a composition selected from the group consisting of (a) 0.16 wt % C, 0.10 wt % Si, 0.41 wt % Mn, 2.80 wt % Cr, 0.44 wt % Cr, 0.44 wt % Mo with the balance being iron and inevitable impurities, (b) 0.34 wt % C, 0.31 wt % si, 0.68 wt % Mn, 1.05 wt % Cr, 0.70 wt % Ni, 1.00 wt % Mo with the balance being iron and inevitable impurities, (c) 0.19 wt % C, 0.51 wt % Si, 1.35 wt % Mn, 0.75 wt % Cr, 0.08 wt % Cu, 0.94 wt % Mo with the balance being iron and inevitable impurities, (d) 0.38 wt % C, 0.79 wt % Si, 2.43 wt % Mn, 0.76 wt % Cr, 0.50 wt % Cu, 0.50 wt % Ni, 0.31 wt % Mo with the balance being iron and inevitable impurities, (e) 0.41 wt % C, 0.81 wt % Si, 0.44 wt % Mn, 0.84 wt % Cr, 1.49 wt % Cu, 0.15 wt % Mo with the balance being iron and inevitable impurities, (f) 0.29 wt % C, 0.45 wt % Si, 0.81 wt % Mn, 1.06 wt % Cr, 0.36 wt % Ni, 0.67 wt % Mo with the balance being iron and inevitable impurities, and (g) 0.30 wt % C, 0.28 wt % Si, 0.61 wt % Mn, 0.91 wt % Cr, 1.54 wt % Cu, 0.98 wt % Ni, 1.15 wt % Mo with the balance being iron and inevitable impurities.

11. The bainite rail of claim 3, wherein the rail has an abrasion loss ratio of 1.43 to 2.84.

12. The bainite rail of claim 4, wherein the rail has a composition selected from the group consisting of (a) 0.44 wt % C, 0.25 wt % Si, 2.48 wt % Mn, 0.73 wt % Cr, 0.31 wt % Mo, 0.048 wt % V with the balance being iron and inevitable impurities, (b) 0.34 wt % C, 0.31 wt % Si, 0.51 wt % Mn, 2.03 wt % Cr, 0.45 wt % Mo, 0.040 wt % V, 0.008 wt % Nb with the balance being iron and inevitable impurities, (c) 0.24 wt % C, 0.51 wt % Si, 1.82 wt % Mn, 0.75 wt % Cr, 0.37 wt % Mo, 0.045 wt % V with the balance being iron and inevitable impurities, (d) 0.19 wt % C, 0.40 wt % Si, 1.10 wt % Mn, 1.53 wt % Cr, 0.15 wt % Mo, 0.022 wt % V, 0.007 wt % Nb, 0.049 wt % Ti with the balance being iron and inevitable impurities, (e) 0.38 wt % C, 0.79 wt % Si, 0.68 wt % Mn, 1.02 wt % Cr, 1.20 wt % Cu, 0.44 wt % Mo, 0.015 wt % V, 0.019 wt % Ti with the balance being iron and inevitable impurities, (f) 0.27 wt % C, 0.45 wt % Si, 0.81 wt % Mn, 1.22 wt % Cr, 1.97 wt % Ni, 0.98 wt % Mo, 0.022 wt % V with the balance being iron and inevitable impurities, (g) 0.31 wt % C, 0.20 wt % Si, 2.02 wt % Mn, 0.81 wt % Cr, 0.15 wt % Cu, 0.20 wt % Ni, 0.47 wt % Mo, 0.012 wt % V with the balance being iron and inevitable impurities, (h) 0.16 wt % C, 0.13 wt % Si, 0.42 wt % Mn, 1.95 wt % Cr, 0.20 wt % Cu, 0.50 wt % Ni, 0.65 wt % Mo, 0.018 wt % V with the balance being iron and inevitable impurities, (i) 0.42 wt % C, 0.06 wt % Si, 0.31 wt % Mn, 0.31 wt % Cr, 0.15 wt % Cu, 0.35 wt % Ni, 1.25 wt % Mo, 0.009 wt % V, 0.005 wt % Nb, 0.001 wt % Ti with the balance being iron and inevitable impurities, (j) 0.30 wt % C, 0.21 wt % Si, 0.50 wt % Mn, 2.11 wt % Cr, 0.08 wt % Cu, 0.13 wt % Ni, 0.35 wt % Mo, 0.031 wt % V, 0.008 wt % Nb, 0.006 wt % Ti with the balance being iron and inevitable impurities, and (k) 0.31 wt % C, 0.35 wt % Si, 0.41 wt % Mn, 0.27 wt % Cr, 0.58 wt % Cu, 0.43 wt % Ni, 1.45 wt % Mo, 0.041 wt % V, 0.009 wt % Nb, 0.002 wt % Ti with the balance being iron and inevitable impurities.

13. A rail of high toughness and high wear resistance, consisting essentially of 0.2 to 0.45 wt. % of C, 0.1 to 2.0 wt. % of Si, 1.0 to 4.0 wt. % of Mn, 0.035 wt. % or less of P, 0.035 wt. % or less of S, 0.3 to 4.0 wt. % of Cr, optionally at least one metal selected from the group consisting of 0.1 to 1.0 wt. % Ni, 0.1 to 1.0 wt. % Mo, 0.01 to 0.1 wt. % Nb and 0.01 to 0.1 wt. % V, and the balance being iron and inevitable impurities, the rail having a metal structure which is a bainite structure, a hardness of higher than 400 Hv at each of a head top portion and a head corner portion thereof, both the head top portion and the head corner portion having a uniform hardness at all sections of the head top portion and the head corner portion, a tensile strength of 1200 MPa or more, and a 2 mm, U-notch Charpy absorbed energy of 30 J or more at +20° C.

14. The rail according to claim 13, containing at least one metal selected from the group consisting of 0.1 to 1.0 wt. % of Ni and 0.1 to 1.0 wt. % of Mo.

15. The rail according to claim 13, containing at least one metal selected from the group consisting of 0.01 to 0.1 wt. % of Nb and 0.01 to 1.0 wt. % of V.

16. The rail according to claim 14, containing of at least one metal selected from the group consisting of 0.01 to 0.1 wt. % of Nb and 0.01 to 1.0 wt. % of V.

17. A rail of high toughness and high wear resistance, consisting essentially of 0.2 to 0.5 wt. % of C, 0.1 to 2.0 wt. % of Si, 1.0 to 4.0 wt. % of Mn, 0.035 wt. % or less of P, 0.035 wt. % or less of S, 0.3 to 4.0 wt. % of Cr, optionally at least one metal selected from the group consisting of 0.1 to 1.0 wt. % Ni, 0.1 to 1.0 wt. % Mo, 0.01 to 0.1 wt. % Nb and 0.01 to 0.1 wt. % V, and the balance being iron and inevitable impurities, the rail having a metal structure which is a bainite structure, and a hardness of higher than 400 Hv at each of a head top portion and a head corner portion thereof, both the head top portion and the head corner portion having a uniform hardness at all sections of the head top portion and the head corner portion.

18. The rail according to claim 17, containing at least one metal selected from the group consisting of 0.1 to 1.0 wt. % of Ni and 0.1 to 1.0 wt. % of Mo.

19. The rail according to claim 17, containing at least one metal selected from the group consisting of 0.01 to 0.1 wt. % of Nb and 0.01 to 1.0 wt. % of V.

20. The rail according to claim 18, containing at least one metal selected from the group consisting of 0.01 to 0.1 wt. % of Nb and 0.01 to 1.0 wt. % of V.

21. The rail according to claim 13, wherein the rail has a composition selected from the group consisting of (a) 0.21 wt. % C, 0.33 wt. % Si, 2.03 wt. % Mn, 0.011 wt. % P, 0.008 wt. % S, 2.03 wt. % Cr with the balance being iron and inevitable impurities, (b) 0.30 wt. % C, 0.32 wt. % Si, 2.03 wt. % Mn, 0.011 wt. % P, 0.008 wt. % S, 2.03 wt. % Cr with the balance being iron and inevitable impurities, (c) 0.41 wt. % C, 0.32 wt. % Si, 2.02 wt.% Mn, 0.011 wt. % P, 0.008 wt. % S, 2.02 wt. % Cr with the balance being iron and inevitable impurities, and (d) 0.49 wt. % C, 0.32 wt. % Si, 2.04 wt. % Mn, 0.010 wt. % P, 0.007 wt. % S, 2.00 wt. % Cr with the balance being iron and inevitable impurities.

22. The rail according to claim 13, wherein the rail has a composition selected from the group consisting of (a) 0.40 wt. % C, 0.32 wt. % Si, 2.05 wt. % Mn, 0.009 wt. % P, 0.007 wt. % S, 0.35 wt. % Cr with the balance being iron and inevitable impurities, (b) 0.41 wt. % C, 0.32 wt. % Si, 2.02 wt. % Mn, 0.011 wt. % P, 0.007 wt. % 5, 0.57 2 wt. % Cr with the balance being iron and inevitable impurities, (c) 0.42 wt. % C, 0.31 wt. % Si, 2.01 wt. % Mn, 0.010 wt. % P, 0.008 wt. % S, 1.00 wt. % Cr with the balance being iron and inevitable impurities, (d) 0.40 wt. % C, 0.33 wt. % Si, 2.01 wt. % Mn, 0.011 wt. % P, 0.007 wt. % S, 1.51 wt. % Cr with the balance being iron and inevitable impurities, (e) 0.41 wt. % C, 0.32 wt. % Si, 2.02 wt. % Mn, 0.011 wt. % P, 0.008 wt. % S, 2.02 wt. % Cr with the balance being iron and inevitable impurities, (f) 0.40 wt. % C, 0.32 wt. % Si, 2.04 wt. % Mn, 0.008 wt. % P, 0.008 wt. % S, 2.52 wt. % Cr with the balance being iron and inevitable impurities, (g) 0.40 wt. % C, 0.32 wt. % Si, 2.04 wt. % Mn, 0.009 wt. % P, 0.008 wt. % S, 3.04 wt. % Cr with the balance being iron and inevitable impurities, (h) 0.42 wt. % C, 0.32 wt. % Si, 2.03 wt. % Mn, 0.010 wt. % P, 0.007 wt. % S, 3.49 wt. % Cr with the balance being iron and inevitable impurities, and (i) 0.41 wt. % C, 0.32 wt. % Si, 2.03 wt. % Mn, 0.10 wt. % P, 0.007 wt. % S, 3.98 wt. % Cr with the balance being iron and inevitable impurities.

23. The rail according to claim 13, wherein the rail has a composition selected from the group consisting of (a) 0.31 wt. % C, 0.34 wt. % Si, 1.02 wt. % Mn, 0.010 wt. % P, 0.007 wt. % S, 2.51 wt. % Cr with the balance being iron and inevitable impurities, (b) 0.30 wt. % C, 0.31 wt. % Si, 1.53 wt. % Mn, 0.010 wt. % P, 0.007 wt. % S, 2.53 wt. % Cr with the balance being iron and inevitable impurities, (c) 0.30 wt. % C, 0.31 wt. % Si, 1.99 wt. % Mn, 0.010 wt. % P, 0.007 wt. % S, 2.53 wt. % Cr with the balance being iron and inevitable impurities, (d) 0.31 wt. % C, 0.31 wt. % Si, 2.48 wt. % Mn, 0.010 wt. % P, 0.007 wt. % S, 2.52 wt. % Cr with the balance being iron and inevitable impurities, (e) 0.32 wt. % C, 0.30 wt. % Si, 3.04 wt. % Mn, 0.009 wt. % P, 0.008 wt. % S, 2.53 wt. % Cr with the balance being iron and inevitable impurities, (f) 0.31 wt. % C, 0.31 wt. % Si, 3.50 wt. % Mn, 0.009 wt. % P, 0.007 wt. % S, 2.52 wt. % Cr with the balance being iron and inevitable impurities, and (g) 0.30 wt. % C, 0.31 wt. % Si, 3.99 wt. % Mn, 0.009 wt. % P, 0.007 wt. % S, 2.52 wt. % Cr with the balance being iron and inevitable impurities.

24. The rail according to claim 14, wherein the rail has a composition selected from the group consisting of (a) 0.40 wt. % C, 0.31 wt. % Si, 1.04 wt. % Mn, 0.011 wt. % P, 0.007 wt. % S, 2.02 wt. % Cr, 0.21 wt. % Ni with the balance being iron and inevitable impurities, (b) 0.39 wt. % C, 0.32 wt. % Si, 1.01 wt. % Mn, 0.012 wt. % P, 0.008 wt. % S, 2.02 wt. % Cr, 0.73 wt. % Ni with the balance being iron and inevitable impurities, (c) 0.40 wt. % C, 0.31 wt. % Si, 1.02 wt. % Mn, 0.012 wt. % P, 0.007 wt. % S, 2.01 wt. % Cr, 0.22 wt. % Mo with the balance being iron and inevitable impurities, (d) 0.41 wt. % C, 0.31 wt. % Si, 1.02 wt. % Mn, 0.010 wt. % P, 0.007 wt. % S, 2.01 wt. % Cr, 0.70 wt. % Mo with the balance being iron and inevitable impurities, and (e) 0.40 wt. % C, 0.31 wt. % Si, 1.04 wt. % Mn, 0.011 wt. % P, 0.007 wt. % S, 2.02 wt. % Cr, 0.21 wt. % Ni, 0.23 wt. % Mo with the balance being iron and inevitable impurities.

25. The rail according to claim 15, wherein the rail has a composition selected from the group consisting of (a) 0.32 wt. % C, 0.32 wt. % Si, 1.51 wt. % Mn, 0.012 wt. % P, 0.008 wt. % S, 2.52 wt. % Cr, 0.03 wt. % Nb with the balance being iron and inevitable impurities, (b) 0.32 wt. % C, 0.32 wt. % Si, 1.51 wt. % Mn, 0.012 wt. % P, 0.008 wt. % S, 2.52 wt. % Cr, 0.08 wt. % Nb with the balance being iron and inevitable impurities, (c) 0.31 wt. % C, 0.31 wt. % Si, 1.51 wt. % Mn, 0.010 wt. % P, 0.008 wt. % S, 2.53 wt. % Cr, 0.03 wt. % V with the balance being iron and inevitable impurities, (d) 0.31 wt. % C, 0.31 wt. % Si, 1.50 wt. % Mn, 0.010 wt. % P, 0.008 wt. % S, 2.53 wt. % Cr, 0.10 wt. % V with the balance being iron and inevitable impurities, and (e) 0.32 wt. % C, 0.32 wt. % Si, 1.51 wt. % Mn, 0.011 wt. % P, 0.008 wt. % S, 2.51 wt. % Cr, 0.09 wt. % Nb, 0.09 wt. % V with the balance being iron and inevitable impurities.

26. The rail according to claim 16, wherein the rail consists essentially of 0.32 wt. % C, 0.31 wt. % Si, 1.51 wt. % Mn, 0.011 wt. % P, 0.008 wt. % S, 2.51 wt. % Cr, 0.20 wt. % Ni, 0.019 wt. % Mo, 0.09 wt. % Nb, 0.09 wt. % V with the balance being iron and inevitable impurities.

27. A method for manufacturing a rail of high toughness and high wear resistance, comprising the steps of:

(a) preparing a steel consisting essentially of 0.2 to 0.45 wt. % of C, 0.1 to 2.0 wt. % of Si, 1.0 to 4.0 wt. % of Mn, 0.035 wt. % or less of P, 0.035 wt. % or less of S, 0.3 to 4.0 wt. % of Cr, optionally at least one metal selected from the group consisting of Ni, Mo, Nb and V, and the balance being iron and inevitable impurities;

(b) hot rolling the steel to have a rolling finishing temperature of 800° to 1000° C., thereby forming a rail stock; and (c) cooling the rail stock at a cooling rate of 5° C./sec. or less in a temperature range between a bainite transformation-starting temperature or more and a temperature of 400° C. or less, whereby to obtain a rail having a bainite structure and a uniform hardness of 400 Hv or more at each of a head top portion and a head corner portion thereof.

28. The method according to claim 27, wherein the steel contains at least one metal selected from the group consisting of 0.1 to 1.0 wt. % of Ni and 0.1 to 1.0 wt. % of Mo.

29. The method according to claim 27, wherein the steel further contains at least one metal selected from the group consisting of 0.01 to 0.1 wt. % of Nb and 0.01 to 1.0 wt. % of V.

30. The method according to claim 29, wherein the steel further contains at least one metal selected from the group consisting of 0.1 to 1.0 wt. % of Ni and 0.1 to 1.0 wt. % of Mo.

* * * * *